US007246411B2

(12) United States Patent
Campbell et al.

(10) Patent No.: US 7,246,411 B2
(45) Date of Patent: Jul. 24, 2007

(54) METHODS AND SYSTEMS FOR SLIDING WINDOWS AND DOORS

(75) Inventors: Kevin Campbell, Klamath Falls, OR (US); Richard Ward Hetherington, Bend, OR (US)

(73) Assignee: Jeld-Wen, Inc., Klamath Falls, OR (US)

( * ) Notice: Subject to any disclaimer, the term of this patent is extended or adjusted under 35 U.S.C. 154(b) by 93 days.

(21) Appl. No.: 10/759,593

(22) Filed: Jan. 16, 2004

(65) Prior Publication Data

US 2005/0132532 A1 Jun. 23, 2005

Related U.S. Application Data

(60) Provisional application No. 60/531,307, filed on Dec. 19, 2003.

(51) Int. Cl.
*B65D 39/08* (2006.01)

(52) U.S. Cl. ..... 16/2.4; 16/2.1

(58) Field of Classification Search ..... 16/105, 16/32, 2.4, 2.1, 82; 411/546, 182; 49/425; 52/127.12, 127.8, 126.5, 365
See application file for complete search history.

(56) References Cited

U.S. PATENT DOCUMENTS 3,236,204 A * 2/1966 Joseph ..... 116/336
3,336,962 A * 8/1967 Foote, Jr. et al. ..... 411/272
3,506,999 A * 4/1970 Neher ..... 174/152 G
4,133,246 A * 1/1979 Small ..... 411/15
4,460,298 A * 7/1984 Solarz et al. ..... 411/15
4,726,722 A * 2/1988 Wollar ..... 411/32
4,817,354 A * 4/1989 Bayer ..... 52/302.7
4,890,966 A * 1/1990 Umezawa ..... 411/340
5,069,512 A * 12/1991 Sykes ..... 312/139.2
5,092,550 A * 3/1992 Bettini ..... 248/188.4
5,294,225 A * 3/1994 Kazino et al. ..... 411/182
5,314,280 A * 5/1994 Gagliardi et al. ..... 411/182
5,409,051 A 4/1995 Mullet et al.
5,549,149 A 8/1996 Sills et al.
5,566,505 A 10/1996 Kamezaki
5,575,321 A 11/1996 Currier (Continued)

FOREIGN PATENT DOCUMENTS

DE 277933 A * 4/1990

(Continued)

OTHER PUBLICATIONS

Patent Cooperation Treaty, International Search Report, International Application No. PCT/US2004/042594, mailed on Apr. 22, 2005, 6 pages.

*Primary Examiner*—Chuck Y. Mah
(74) *Attorney, Agent, or Firm*—Nelson Mullins Riley & Scarborough LLP

(57) ABSTRACT

An adjustable mechanism for sliding panels, such as sliding windows and doors is disclosed. One embodiment comprises adjustable buttons that extend from a housing positioned in the sliding panel. The adjustable threaded buttons of the present invention provide a surface having reduced friction that extends from the bottom edge of a window or door and that can slide along a track supporting the window or door. In addition to providing a mechanism to facilitate horizontal sliding of a window or door, the adjustable buttons may be used to set the height of the sliding window or door as it sits in its frame.

10 Claims, 15 Drawing Sheets

U.S. PATENT DOCUMENTS

| | | | | |
|---|---|---|---|---|
| 5,598,606 | A | | 2/1997 | Jacobs |
| 5,619,822 | A | | 4/1997 | Trompert |
| 5,671,502 | A | | 9/1997 | Ezman |
| 5,694,719 | A | * | 12/1997 | Bejune et al. ..... 49/502 |
| 5,724,770 | A | | 3/1998 | McAfee |
| 5,746,559 | A | * | 5/1998 | Shirai ..... 411/182 |
| 5,950,279 | A | | 9/1999 | Chaput |
| 6,024,815 | A | | 2/2000 | Norton |
| 6,076,304 | A | | 6/2000 | Carrier |
| 6,088,878 | A | * | 7/2000 | Antonucci et al. ..... 16/86 A |
| 6,167,936 | B1 | | 1/2001 | Stover et al. |
| 6,199,331 | B1 | | 3/2001 | Hunt |
| 6,227,281 | B1 | | 5/2001 | Martin |
| 6,250,360 | B1 | | 6/2001 | Ochoa |
| 6,272,793 | B1 | | 8/2001 | Davlantes |
| 6,282,770 | B1 | | 9/2001 | Lyon |
| 6,336,247 | B1 | | 1/2002 | Schnoor |
| 6,345,477 | B1 | | 2/2002 | Kepler et al. |
| 6,357,808 | B1 | | 3/2002 | Supernat |
| 6,382,689 | B1 | | 5/2002 | Brown |
| 6,434,789 | B1 | | 8/2002 | Kruse |
| 6,449,906 | B1 | | 9/2002 | Jacobs |
| 6,467,125 | B1 | | 10/2002 | Johnson |
| 6,497,072 | B2 | | 12/2002 | Fries |
| 6,550,210 | B1 | | 4/2003 | Levine et al. |
| 6,611,990 | B1 | | 9/2003 | Sogo et al. |
| 6,826,878 | B1 | * | 12/2004 | Rovtar ..... 52/213 |
| 2002/0043912 | A1 | | 4/2002 | Lyon |
| 2004/0083653 | A1 | | 5/2004 | Delgado et al. |
| 2004/0098919 | A1 | | 5/2004 | Bourque et al. |
| 2004/0107642 | A1 | | 6/2004 | Liebscher |
| 2004/0159048 | A1 | | 8/2004 | Jacobs |

FOREIGN PATENT DOCUMENTS

| | | | | |
|---|---|---|---|---|
| DE | 198 08 194 | A1 | | 9/1999 |
| DE | 102 08 362 | A1 | | 9/2003 |
| EP | 0 674 082 | A1 | | 9/1995 |
| EP | 0779406 | A1 | | 6/1997 |
| EP | 0940542 | A2 | | 9/1999 |
| EP | 0943772 | A2 | | 9/1999 |
| EP | 0985793 | A2 | | 3/2000 |
| EP | 0753637 | B1 | | 4/2000 |
| EP | 0631643 | B1 | | 6/2000 |
| EP | 1085154 | A2 | | 3/2001 |
| EP | 0985793 | A3 | | 7/2001 |
| EP | 1120513 | A2 | * | 8/2001 |
| EP | 0855487 | B1 | | 11/2002 |
| EP | 0795072 | B1 | | 3/2003 |
| EP | 0940542 | A3 | | 3/2003 |
| EP | 1335096 | A2 | | 8/2003 |
| EP | 0943772 | A3 | | 9/2003 |
| EP | 1375804 | A2 | | 1/2004 |
| FR | 2538690 | A1 | * | 7/1984 |
| FR | 2824103 | A3 | * | 10/2002 |
| JP | 01151636 | A | * | 6/1989 |
| JP | 05340070 | A | * | 12/1993 |
| JP | 09020488 | A | * | 1/1997 |
| JP | 09112135 | A | * | 4/1997 |
| JP | 2002106262 | A | * | 4/2002 |
| WO | WO 96/04451 | | | 2/1996 |
| WO | WO 98/30777 | | | 7/1998 |
| WO | WO 98/40596 | | | 9/1998 |
| WO | WO 01/18343 | A1 | | 3/2001 |
| WO | WO 03/104598 | A1 | | 12/2003 |
| WO | WO 2004/056244 | | | 7/2004 |
| WO | WO 2004/059115 | A1 | | 7/2004 |

* cited by examiner

A

B

METHODS AND SYSTEMS FOR SLIDING WINDOWS AND DOORS

CROSS REFERENCE TO RELATED APPLICATIONS

This application claims priority to U.S. Provisional Application Ser. No. 60/531,307, filed Dec. 19, 2003. The disclosure of U.S. Provisional Application Ser. No. 60/531,307 is incorporated herein by reference.

FIELD OF INVENTION

The present invention relates to sliding windows and doors and more particularly to mechanisms for facilitating accurate positioning and movement of sliding window and door panels.

BACKGROUND

Sliding windows and doors are often used in houses or other types of buildings to provide a means to have a relatively large panel that can open to the outside or between rooms. Sliding windows and doors allow for relatively large structures to be opened without having the unit extend outwardly and be exposed to the outdoors, or inwardly and take up living space.

Various mechanisms have been used to allow windows and doors to slide horizontally within a frame. In some cases the window unit is positioned in a track such that the bottom portion of the window can slide along the track. Generally, the track is made of vinyl or some other type of plastic to reduce friction between the window and the track.

Also, for vinyl or aluminum windows, a plastic housing with brass or nylon roller wheels can be attached to the bottom of the window sash. Still, these systems can be problematic in that dirt can build up underneath the rollers or in the track such that the rollers seize up and do not actually roll, but slide on the track. Similar systems comprising multiple ball bearings and rollers may be used for sliding doors.

Other systems use plastic pins having enlarged heads that can be inserted into the bottom sash of a window, such that the window can slide on the head of the pin. The pins can be problematic, however, in that it is easy to apply the pins in the wrong position. Also, once inserted into the window sash, the relative depth or positioning of the pins cannot be adjusted. Thus, in the case where there is settling or shifting of the window frame, the sash may end up being vertically out of position with the frame.

Also, many manufacturers employ a self-latching lock system with sliding windows. Self-latching locks require that the window be precisely positioned such that the portion of the lock in the window sill is correctly aligned with the portion of the lock on the window. Often, as the building foundation settles, portions of the window and/or window sill may shift, such that a lock that was properly positioned comes out of alignment. To realign the lock requires removing the lock from the window or window sill, and repositioning the individual lock parts.

Thus, there is a need for an improved mechanism for sliding windows and doors. The mechanism should allow for precise placement of the window or door within the sliding track to reduce friction associated with sliding of the window or door. Also, the mechanism should be adjustable to allow for the window or door to be precisely aligned (or realigned upon settling of the building) with the window sill or door frame. Also, there is a need for a sliding mechanism that can be used with self-latching locks to provide flexibility in positioning windows and doors.

SUMMARY

Embodiments of the present invention comprise methods and systems for sliding windows and doors. One embodiment of the present invention comprises an adjustable mechanism to facilitate accurate positioning and movement of sliding panels, such as sliding windows and doors. In an embodiment, the present invention comprises adjustable buttons that extend from a housing positioned in the sliding panel. The adjustable buttons of the present invention provide a surface having reduced friction that extends from the bottom edge of a window or door and that can slide along a track supporting the window or door. In addition to providing a mechanism to facilitate horizontal sliding of a window or door, the adjustable buttons may be used to set the height of the sliding window or door as it sits in a frame.

Thus, in an embodiment, the present invention comprises an assembly for a sliding panel comprising a housing unit and an insert. In an embodiment, the housing unit may comprise a chamber having a first end and a second end, where the first end is shaped for insertion into the sliding panel and the second end comprises an aperture. Also, the housing unit may comprise at least one guide for positioning the housing in the sliding panel. In an embodiment, the insert comprises a surface having reduced friction that extends from the housing. Thus, the insert may be designed to fit into the aperture on the second end of the housing in such a manner as to extend beyond the surface of the housing.

In another embodiment, the present invention comprises an article of manufacture comprising a sliding window or door having at least one adjustable assembly to facilitate sliding the window or door at least partially within its frame. In an embodiment, the adjustable assembly comprises a housing unit and an insert. The housing may further comprise a chamber having a first end and a second end, where the first end is shaped for insertion into a window sash or doorframe and the second end comprises an aperture. Also, in an embodiment, the housing may additionally comprise at least one positioning guide for positioning the housing in the window or door. In an embodiment, the insert fits into the aperture on the second end of the housing to extend beyond the surface of the housing.

In yet another embodiment, the present invention comprises a method for making a sliding panel having adjustable vertical positioning comprising fitting the panel with a housing having an insert that may be adjusted to extend from the housing to abut a surface on which the panel slides. In an embodiment, the method comprises fitting the sliding panel with an adjustable sliding assembly comprising a housing unit, wherein the housing unit comprises a chamber having a first end and a second end, such that the first end is shaped for insertion into a sliding panel and the second end comprises an aperture. In an embodiment, the housing may include at least one guide for positioning the housing in the sliding panel. The insert may be placed in the aperture on the second end of the housing to extend beyond the surface of the housing and the panel. The insert may be positioned in the housing prior to, or after, the housing is inserted in the sliding panel. Once the insert has been positioned in the housing, the height of the sliding panel relative to a surrounding frame is adjusted by varying the distance that the insert extends from the aperture in the housing.

The present invention may be better understood by reference to the description and figures that follow. It is to be understood that the invention is not limited in its application to the specific details as set forth in the following description, figures, and claims, but is capable of other embodiments and of being practiced or carried out in various ways.

BRIEF DESCRIPTION OF THE FIGURES

The present invention may be better understood by reference to the following non-limiting figures.

DETAILED DESCRIPTION

Figure 1:
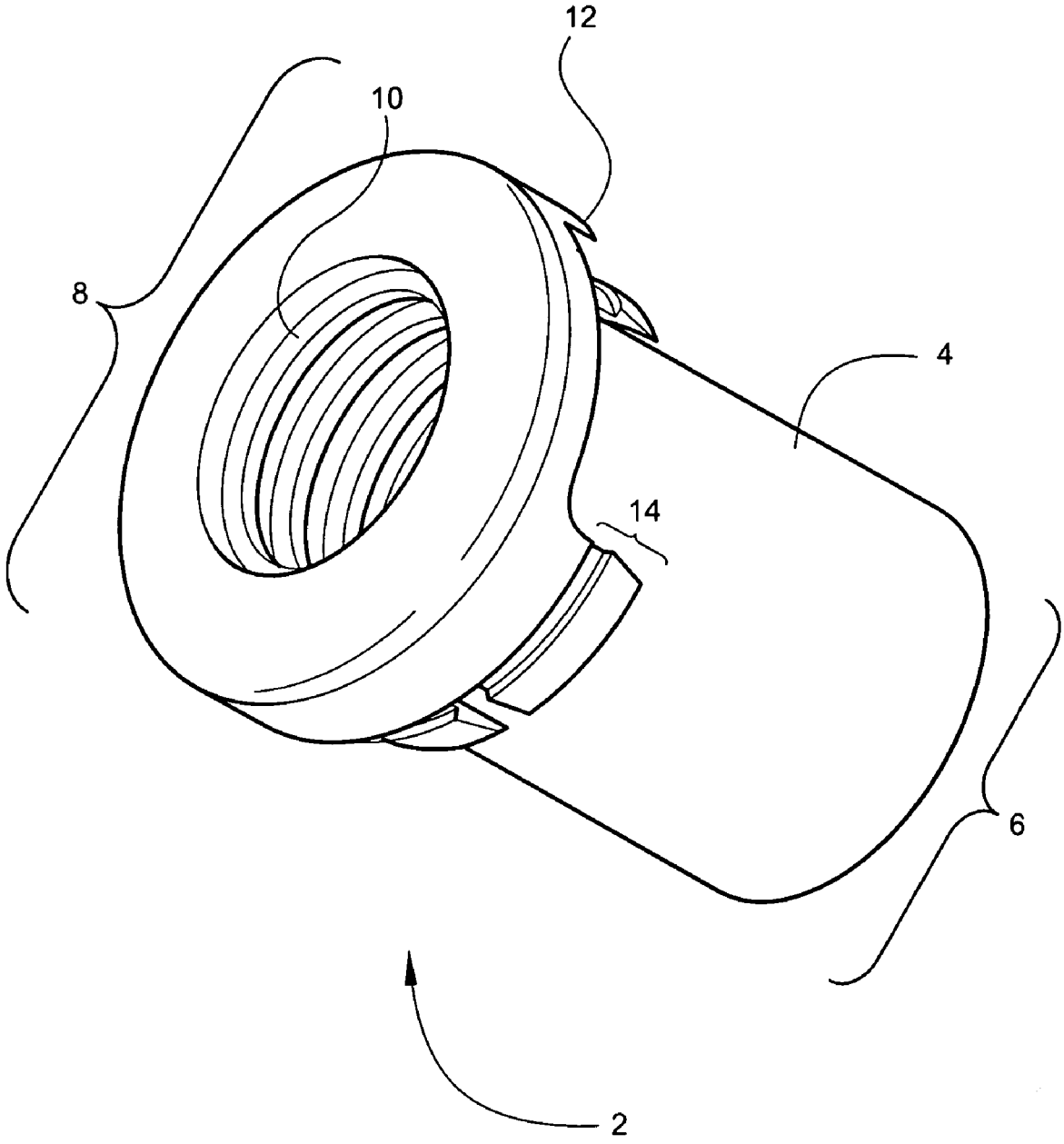
FIG. 1 shows a perspective view of a housing unit for insertion into a vinyl window sash comprising a threaded aperture for insertion of an adjustable button in accordance with an embodiment of the present invention.

Embodiments of the present invention comprise methods and systems for sliding windows and doors. One embodiment of the present invention comprises an adjustable mechanism to facilitate the accurate positioning and sliding of windows and doors that are designed to slide within a frame or track. In one embodiment, the assembly of the present invention comprises two parts: (1) a housing that fits into the sliding panel, and (2) an insert that fits into the housing in such a manner as to extend beyond the surface of the sliding panel. In an embodiment, the insert may be a threaded cylindrical button. Because the inserts comprise a material having a relatively low frictional coefficient, they present a surface which can slide along a track in a sliding window or sliding door unit. Also, by adjusting how far the buttons extend from the housing, the adjustable mechanism may be used to set the height of the sliding panel as it sits in the track.

Thus, in an embodiment, the present invention comprises an assembly for a sliding panel comprising: (a) a housing unit, where the housing comprises a chamber having a first end and a second end, such that the first end is shaped for insertion into a sliding panel and the second end comprises an aperture, and where the housing further comprises at least one guide for positioning the housing in a sliding panel; and (b) an insert that fits into the aperture on the second end of the housing to extend beyond the surface of the housing.

For example, in an embodiment, the present invention may comprise an assembly for a sliding panel comprising: (a) a housing having a chamber comprising a first end and a second end, where the first end is shaped for insertion into a sliding panel, and the second end comprises a threaded aperture, and where the housing further comprises at least one guide for positioning the housing in a sliding panel; and (b) a threaded cylindrical insert that fits into the aperture on the second end of the housing to extend beyond the surface of the housing.

In another embodiment, the present invention comprises an article of manufacture comprising a sliding panel having at least one adjustable assembly to facilitate sliding the panel at least partially within a frame, where the adjustable assembly comprises: (a) a housing comprising a chamber having a first end and a second end, such that the first end is shaped for insertion into the sliding panel and the second end comprises an aperture, and where the housing further comprises at least one guide for positioning the housing in the panel; and (b) an insert that fits into the aperture on the second end of the housing to extend beyond the surface of the housing.

The present invention also comprises methods for making sliding panels. In an embodiment, the present invention comprises a method for making a sliding panel having adjustable vertical positioning comprising fitting the panel with a housing having an insert that may be adjusted to extend from the housing to abut a surface on which the panel slides. In an embodiment, the method comprises the steps of:

(a) fitting the sliding panel with an adjustable sliding assembly comprising a housing unit, where the housing unit comprises: (i) a chamber having a first end and a second end, such that the first end is shaped for insertion into a sliding panel and the second end comprises an aperture; and (ii) a guide for positioning the housing in the sliding panel;

(b) positioning an insert in the aperture on the second end of the housing to extend beyond the surface of the housing and the panel; and (c) adjusting the height of the sliding panel to be compatible with its frame by adjusting the extent that the insert extends from the aperture in the housing aperture.

The sliding panel may comprise a variety of forms. In an embodiment, the sliding panel comprises a window. The adjustable sliding assembly of the present invention may be used on any type of sliding window such as, but not limited to, wood, vinyl, and aluminum sliding windows. For example, in an embodiment, the sliding panel may comprise a window having a sash weight up to about 50 pounds.

In an embodiment, the sliding panel may comprise a door. In an embodiment, sliding doors that include a window pane may use the adjustable mechanism of the present invention. Or, the door may comprise a sliding screen door. In addition, the sliding panel may comprise a solid door or other type of wood panel. For example, the adjustable mechanism of the present invention may be used for a sliding door that connects one room to another room, or that connects an indoor room to a porch or patio.

In an embodiment, the housing provides a unit into which the sliding part is inserted. The housing is designed to be compatible with the sliding panel into which the housing is inserted. Also in an embodiment, the first end of the housing is positioned at a preset distance from the second end of the housing such that when the housing is inserted into the sliding panel, the first end of the housing (i.e., the end inserted into the sliding panel) abuts at least a portion of the interior of the sliding panel.

Where the housing unit is inserted into a window sash, the housing may have an outer circumference (or width) which is less than the internal depth of the window sash. Also, in an embodiment, the housing may have an outer shape that allows for the housing to be inserted between various structural elements of a window sash or doorframe. For example, in an embodiment, the housing is shaped to fit between projecting rails that form a detent in the window sash.

In an embodiment, the housing chamber is at least partly cylindrical in shape. This allows the housing to be inserted in a hole that is drilled into the sliding panel. This embodiment may be used, for example, for housing units that are inserted into vinyl window sashes.

Where the housing is cylindrical in shape, the housing may comprise at least one non-cylindrical surface for positioning the housing in the sliding panel. For example, as described above, the housing may need to be inserted between various structural units (e.g., such as rails and the like) that may be part of the sliding panel. Thus, in an embodiment, the housing chamber comprises a cylinder having at least one planar surface. In an embodiment, the structural element in the sliding panel (e.g., the planar surface) may act to support the housing in the panel.

In yet another embodiment, the housing chamber is at least partly square or rectangular in shape. For example, a square or rectangular housing may be preferred for use in a metal sash or rail. For example, the housing may comprise a rectangular body having at least one flat planar extension that is positioned on the first end of the housing and extends perpendicular to the length of the aperture in the housing. This extension may be inserted in the rail of a window sash or doorframe. This housing design may be preferable for use in aluminum window sashes because typical aluminum window sash components are not hollow in nature. Alternatively, and/or additionally, the housing for an aluminum sash may be designed to be fastened to the aluminum sash using a screw, bolt or other type of fastening agent. For example, in an embodiment, the housing may comprise a tab for insertion of the housing into a metal sash rail, as well as a second tab having an aperture for securing the housing in place.

The housing may comprise some type of guide for positioning the housing in the sliding panel. In this way, the housing is positioned appropriately for insertion of a button or other type of sliding piece. In an embodiment, the positioning guide extends from an external surface of the housing to abut a portion of the sliding panel into which the housing is inserted.

The positioning guide may comprise a variety of designs to facilitate positioning of the housing in a sliding panel. As with the shape of the housing, the shape and/or design of the positioning guide may depend on the sliding panel. Thus, the positioning guide may comprise a flat planar surface that extends from the housing in a direction that is perpendicular to the length of the aperture in the housing chamber. In an embodiment, the positioning guide comprises at least one flat planar extension positioned around the outer circumference of the aperture on the second (i.e., outer) end of the housing. For example, where the housing is cylindrical in shape, the positioning guide may comprise a lip that extends perpendicular to the length of the aperture in the housing to thereby increase the outer circumference of the housing at the second (outer) end.

Alternate positioning guides may be used. For example, the positioning guide may comprise a surface that is substantially concentric with the body of the housing and that is spring-like in design. In an embodiment, this positioning guide acts in a spring-like manner to exert an outward force from the housing to impinge on at least a portion of the sliding panel into which the housing has been inserted. In this way, the positioning guide may secure the housing in place in the sliding panel. To further facilitate placement of the housing in the sliding panel, the positioning guide may comprise a plurality of spring-like guides spaced around the outer surface of the housing unit.

The housing unit may comprise more than one type of positioning guide. In an embodiment, multiple positioning guides may work together to position the housing in the sliding panel. Thus, in an embodiment, the positioning guide may comprise a flat planar surface shaped like a lip that extends from the second (outer) surface of the housing, as well as concentrically positioned spring-like flaps that extend down from the lip. This arrangement may be used where the housing has a cylindrical body. Also in an embodiment, the concentrically placed flaps comprise ridges such that once the housing is inserted in the sliding panel, the ridges engage at least a portion of the sliding panel to prevent the housing from being removed from the panel. In an embodiment, the flaps are angled inwardly, such that the housing may be inserted in a hole drilled in a rail of a window sash. As the housing is inserted, the ridges on the flaps are able go through the opening of the hole. Once the housing is positioned within the hole, however, the flaps expand outwardly such that the ridges press against the inner cavity of the rail in such a manner as to prevent the housing from being removed.

Also in an embodiment, the positioning guide comprises an element that allows the housing to be inserted into the rail of a metal window sash. In an embodiment, the housing is directly fastened to the window sash. For example, the positioning guide may comprise an extension of the housing that comprises an aperture for a screw or other type of fastening element to fasten the housing into the window sash.

In one embodiment the housing may comprise two tab-like positioning guides. Thus, the housing may comprise a flat planar extension on one end of the housing for insertion in the rail of a window sash or doorframe. Additionally, the housing for an aluminum sash may comprise a tab for insertion of the housing into a metal sash rail, as well as a second tab having an aperture for securing the housing in place using a screw, bolt or other type of fastening agent.

Alternatively and/or additionally, the positioning guide may comprise arms that extend from the second (i.e. outer) end of the housing, in a direction parallel to the insert that extends from the housing. In an embodiment, the positioning guide may comprise at least one U-shaped arm that extends from the second end of the housing to impinge on at least a portion of the sliding panel. For example, U-shaped arms may be used to secure the housing in place by encasing a portion of a wall of the sash extrusion. Alternatively and/or additionally, the at least one U-shaped arm may abut at least a portion of a track in which the sliding panel slides. Thus, in an embodiment, the positioning guide also functions to center the sash in the frame.

The insert may comprise a variety of sizes and shapes. In an embodiment, the insert is cylindrical in shape.

In an embodiment, the amount that an insert extends from the housing may be adjusted. In this way, the vertical positioning of the sliding panel may be adjusted. Thus, in an embodiment, as the distance that the inserts extend from the bottom of a sliding panel increases, so will the height of the panel relative to its frame. In an embodiment, the aperture in the second end of the housing comprises a threaded surface. Also in an embodiment, the insert may comprise a threaded surface compatible with the threaded surface in the housing. Thus, by adjusting the amount that the insert is threaded into the aperture, the distance that the insert extends from the housing may be varied.

Because the insert presents a relatively smooth surface, it may be difficult to grab the insert to turn it once the insert has been positioned in the housing. Thus, in an embodiment, the insert comprises an aperture for insertion of a tool for adjusting the position of the insert in the housing.

The adjustable assembly of the present invention should be sturdy enough to support the weight of the sliding panel for which it is to be used. Also, the surface should facilitate sliding of the panel. Also, the material used for the housing should be strong enough to retain its shape upon insertion into the frame of a sliding panel. To facilitate sliding, the threaded insert should be made of a material having a relatively low frictional coefficient.

In an embodiment, the housing and/or threaded insert comprises a single material. Or, different materials may be used for the housing and the insert. Or, different materials may be used for different parts of the housing. In an embodiment, the housing and insert may be made of plastic. Thus, the housing and insert may comprise materials such as polyvinyl chloride (PVC), polypropylene, polyethylene, vinyl, nylon, fiber-filled nylon, polycarbonate, and any other durable material which can be formed by injection molding. Alternatively, the housing may be made of metal and the button made of plastic or vice versa. Thus, in an embodiment, the housing may be made of aluminum, cast zinc, cast steel, cast brass, cast bronze, and the like.

Thus, the present invention comprises an adjustable assembly for sliding panels. In an embodiment, the assembly comprises adjustable buttons that can be attached via a housing to a window or door to facilitate sliding of the window or door in a track. The adjustable buttons of the present invention may be installed at the manufacturing site or after the window or door unit has been transported to the building site. In addition to facilitating sliding of the windows or doors, the buttons of the present invention may be adjusted to raise or lower the sliding panel in its frame. Thus, the adjustable buttons of the present invention are particularly suited to sliding windows that employ self-latching locks.

A sliding panel, as used herein, encompasses any flat piece or panel that may slide in relation to the aperture or frame into which it is inserted. Sliding panels include, but are not limited to, sliding windows (horizontal and vertical); sliding doors (glass and solid); and sliding room dividers (e.g., a panel connecting one room to another via an opening in the wall). Thus, the aperture in which the sliding panel sits may comprise a window sill, a doorframe, or a similar type of aperture present in a building structure.

Various mechanisms have been used to make windows and doors that slide horizontally. Generally, such units include a track for the sliding panel. As used herein, a track may comprise a groove or other type of contained strip which guides the movement of the sliding panel relative to the aperture in which the panel sits. Windows may be designed to slide horizontally or vertically. For panels that slide horizontally, a lower track may be used. Alternatively and/or additionally, an upper track may be used. For example, upper tracks may be required for particularly heavy window units or doors.

As used herein, the part of a window that is inserted in the track and which slides through the track is the bottom rail of the sash. As used herein, sash comprises the frame that holds the glass in a window and which can slide either horizontally or vertically in the grooves of a window aperture. Also as used herein, the part of a door that slides in a track may be termed the door panel. In addition, and as used herein, the horizontal parts of the window sash and door panel are termed rails, and the vertical parts of the window sash and door panel are termed stiles.

As described above, in an embodiment, there are two components to the adjustable mechanism of the present invention: (1) a housing; and (2) an insert that when placed in the housing, provides a smooth, relatively low friction surface that extends beyond the bottom edge of a sliding panel to provide a surface on which the panel can slide.

The housing is the portion of the unit that is inserted in the part of the sliding panel that comprises a sliding surface. In an embodiment, the sliding surface is adjacent to, and abuts, a sliding track. The housing provides a receptacle for an insert that will provide a resilient surface having a low frictional coefficient. The insert provides the surface on which the panel will slide.

In an embodiment, the housing may comprise a unit that is inserted into a window or door to hold a threaded button as the insert. The housing may have a variety of shapes and forms depending on the type of sliding panel being used. Sliding panels, such as windows and doors, vary in construction based on the material used to make the panel, as well as the nature of the sliding panel that is being made. Thus, in an embodiment, there is a first housing design that may be preferable for vinyl windows, a second housing design that may be preferable for aluminum windows, and a third housing design that may be preferable for wood windows. Yet other embodiments may be preferred as housing units for sliding doors.

FIGS. 1-4 show alternate embodiments of a housing of the present invention that may be used in sliding glass windows having a vinyl sash. As shown in FIGS. 1-4, the housing (2) may comprise a substantially cylindrical body (4) having a first end (6) and a second end (8). The second end (8) may comprise an aperture (10). In an embodiment, the aperture (10) at the second end (8) comprises a threaded cylindrical hole into which a threaded button may be inserted. For example, for a vinyl window that slides horizontally in a track, the first end (6) of the housing is inserted into the bottom rail (or sash) of the window, and the second end (8) is positioned to be substantially flush with the lower edge of the sash.

Figure 3:
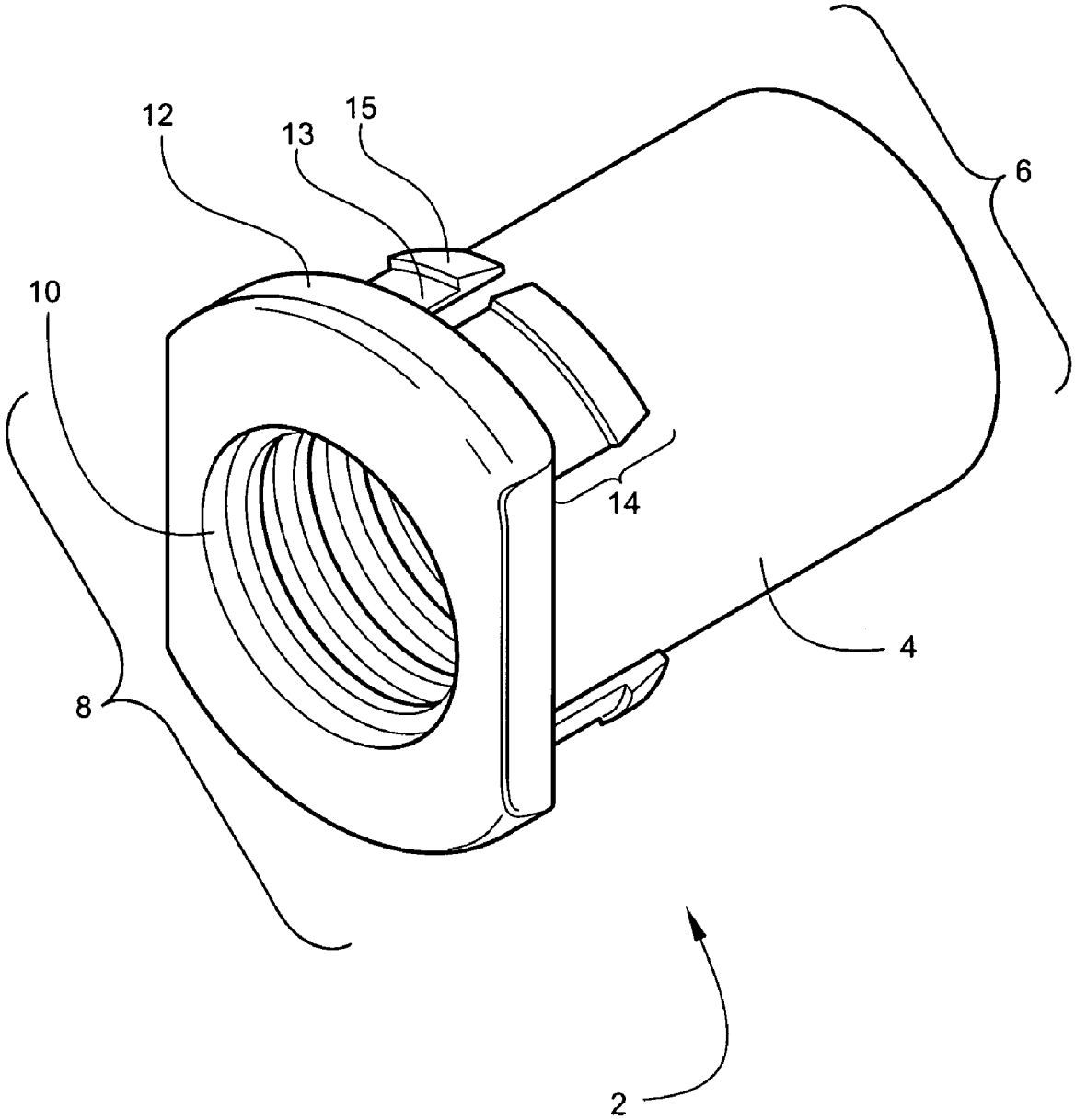
FIG. 3 shows a perspective view of an alternate housing unit for insertion into a vinyl window sash comprising a threaded aperture for insertion of an adjustable button in accordance with an embodiment of the present invention.

The housing typically includes some type of positioning guide for setting the housing at a precise position in the panel into which the housing is placed. The positioning guide may comprise a flat planar surface at the end of the housing that extends from the surface of the sliding panel. In an embodiment, the positioning guide is a surface that extends perpendicular to the body of the housing. For example, as shown in FIGS. 1 and 3, in an embodiment, the positioning guide comprises a lip (12) that extends from the second end (8) of the housing. For example, when using this type of positioning guide, a hole having the circumference of the housing body (4) can be drilled into the bottom rail of a sliding panel and the housing pushed up into the hole until the lip (12) prevents the housing from being inserted any further.

Another type of positioning guide may comprise a surface that is substantially concentric with the body of the housing and that exerts an outward force from the housing to impinge on at least a portion of the sliding panel into which the housing is installed. Thus, the housing unit may comprise spring-like expandable elements (14) as a type of positioning guide. These expandable elements are designed to exert a force outward, thereby securing the housing in the sliding panel. In an embodiment, and as shown in FIGS. 1-4, the positioning guide may comprise a plurality of spring-like expandable elements (14) spaced around the outer surface of the housing unit.

The housing unit may comprise more than one type of positioning guide. In an embodiment, the multiple positioning guides may work together to position the housing in the sliding panel. Thus, as shown in FIGS. 1-4, the lip (12) that extends from the second (outer) surface (8) of the housing may comprise concentrically positioned expandable elements (14) as flaps that extend down from the lip (14). The flaps may include a fairly thin connector (13) which makes the flaps flexible at that point. In an embodiment, the flaps include a ridge (15) that is angled inwardly such that when the housing is inserted through a hole in the rail of a window sash, the flaps are able to go through the hole. Once the housing is positioned within the cavity of the rail, the flaps can expand outwardly, such that the ridges prevent the housing from being pulled back through the hole.

Figure 2:
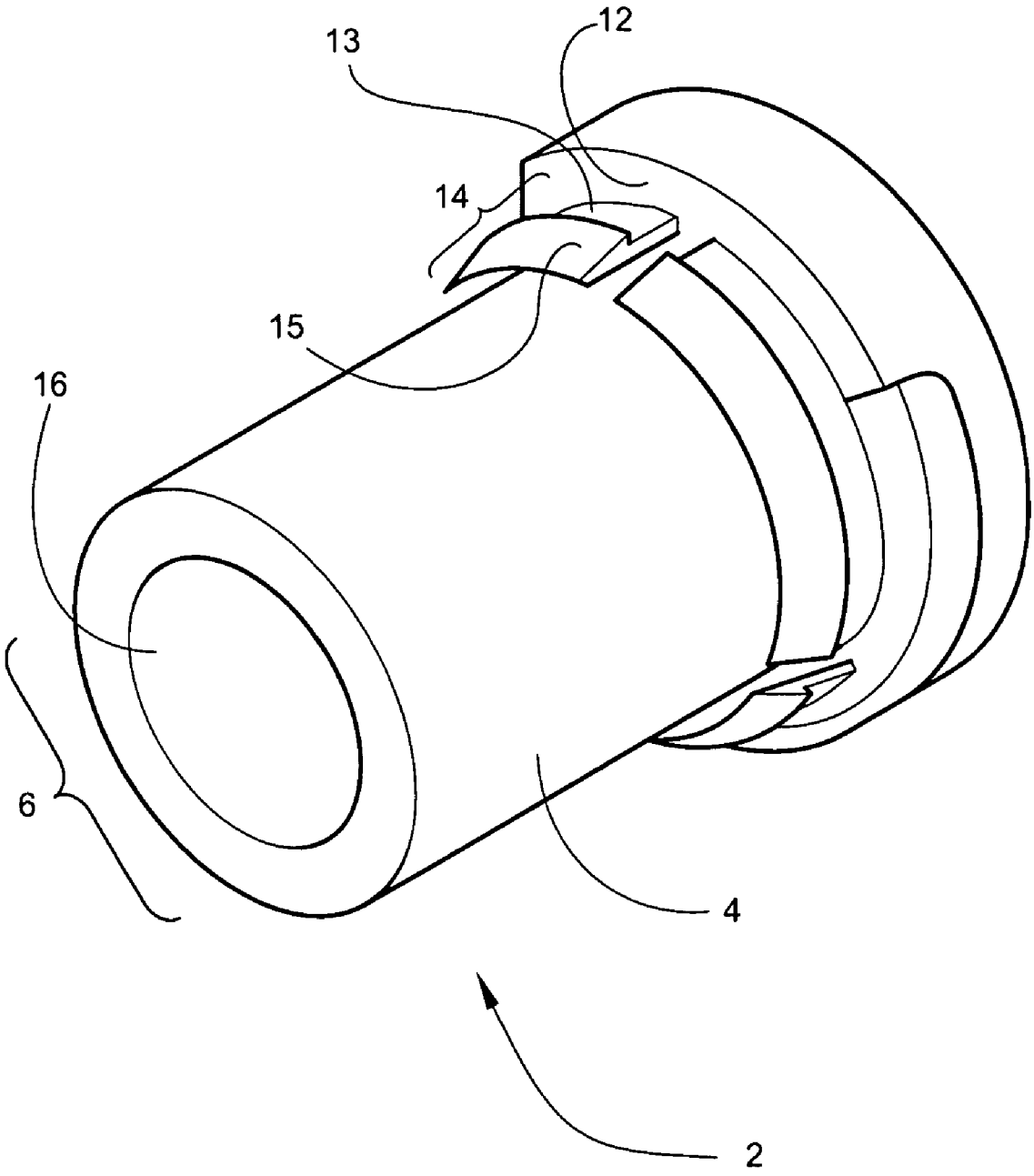
FIG. 2 shows a perspective view of a housing unit for insertion into a window showing the end of the unit that is inserted into the window sash in accordance with an embodiment of the present invention.
Figure 4:
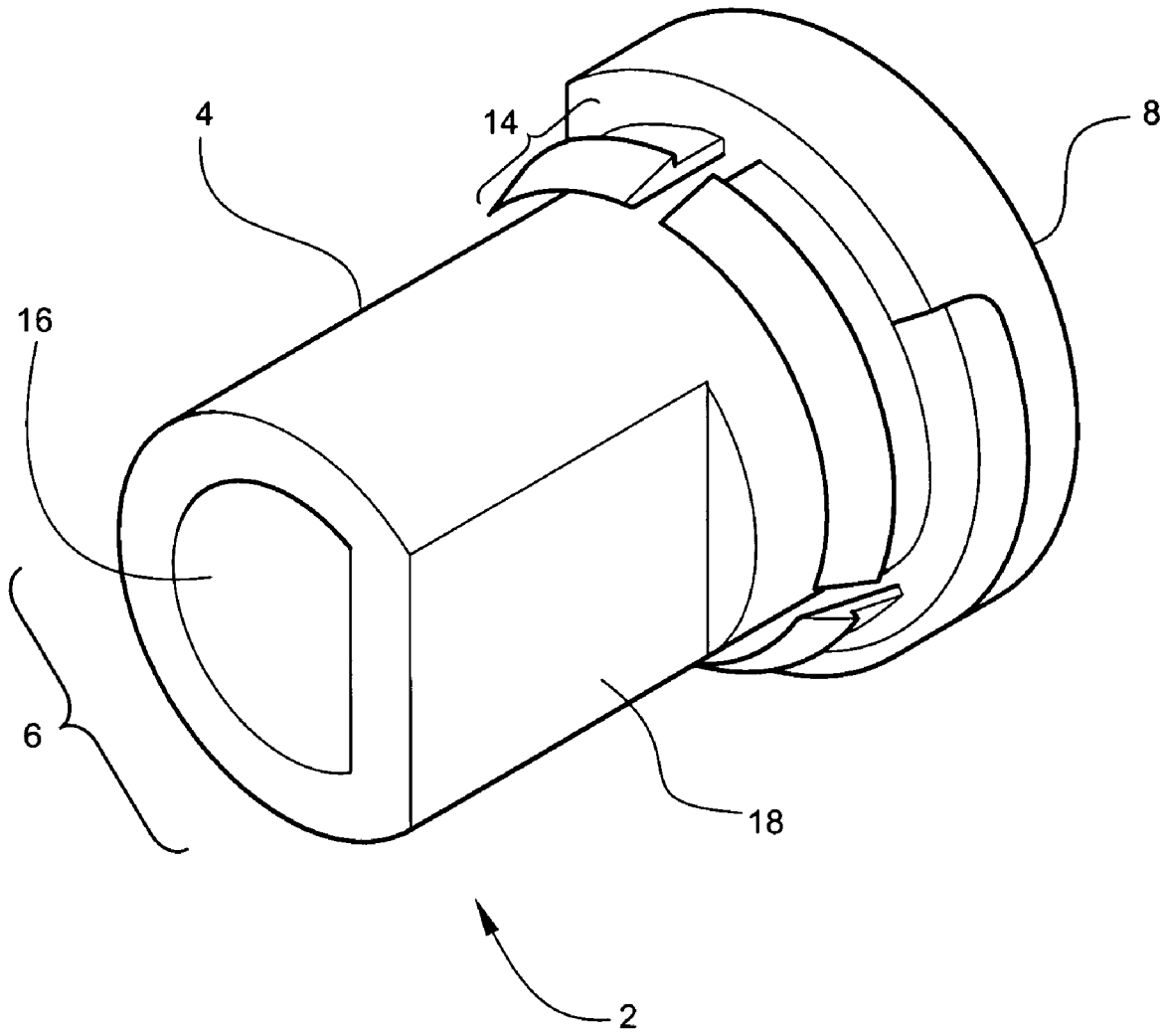
FIG. 4 shows a perspective view of a housing unit where the body of the housing has a planar surface in accordance with an embodiment of the present invention.

Referring now to FIGS. 2 and 4, in an embodiment, the first end (6) of the housing (2) (i.e., the end inserted into the frame of the sliding panel) may also comprise an aperture (16). Generally, the aperture on the end of the housing inserted into the sliding panel is not threaded or modified for insertion of a second piece. In an embodiment, the second aperture on the first end of the housing reduces the amount of material used for the housing. Also, the second aperture may be formed as part of the injection molding process used to make the housing. Also, the second aperture may provide flexibility in the housing for insertion into the frame of a sliding panel.

In an embodiment, the aperture in the first end of the housing (16) does not connect to the aperture in the second end of the housing (10). Thus, there may be a region in the center of the housing which is solid all the way through. The solid section of the housing provides a stop point such that an insert threaded into the aperture on the second end of the housing cannot be completely threaded through the housing. Also, the solid center allows for the housing to be squeezed into a hole drilled into the frame of a sliding panel without collapsing.

FIG. 4 shows an embodiment of the housing in which a substantially cylindrical housing body (4) has at least one flat surface (18). In an embodiment, the flat surface allows for the housing to be placed adjacent to a flat rail (or other support) in the frame of a window unit. Preferably, where part of the housing comprises a flat surface, there is room in the housing body (4) for the threaded aperture in the second end of the housing (8) to extend deep enough into the housing to accommodate the threaded button. Similar modifications to make the housing compatible with various window units known in the art are within the scope of the present invention. For example, the housing may have two flat surfaces, so that it may be inserted between two rails in the frame of a window. Or, the outside of the housing may be threaded so that it may be screwed into a hole in the frame of a wooden sliding panel. In an embodiment, the housing may also be designed so that it could be "press fit" (i.e., no mechanical fastening) into a wood sash or wood sash component.

In an embodiment, the present invention teaches the use of threaded buttons that extend from the body of the housing to provide an adjustable, low-friction surface on which a panel may slide. Thus, the housing allows for a surface on which the panel may slide to be attached to a sliding window or door. By varying the length of the buttons inserted into the housing, or the distance that the buttons (or other insert) extend from the housing, the distance that the sliding surface extends from the housing may be varied.

Figure 5:
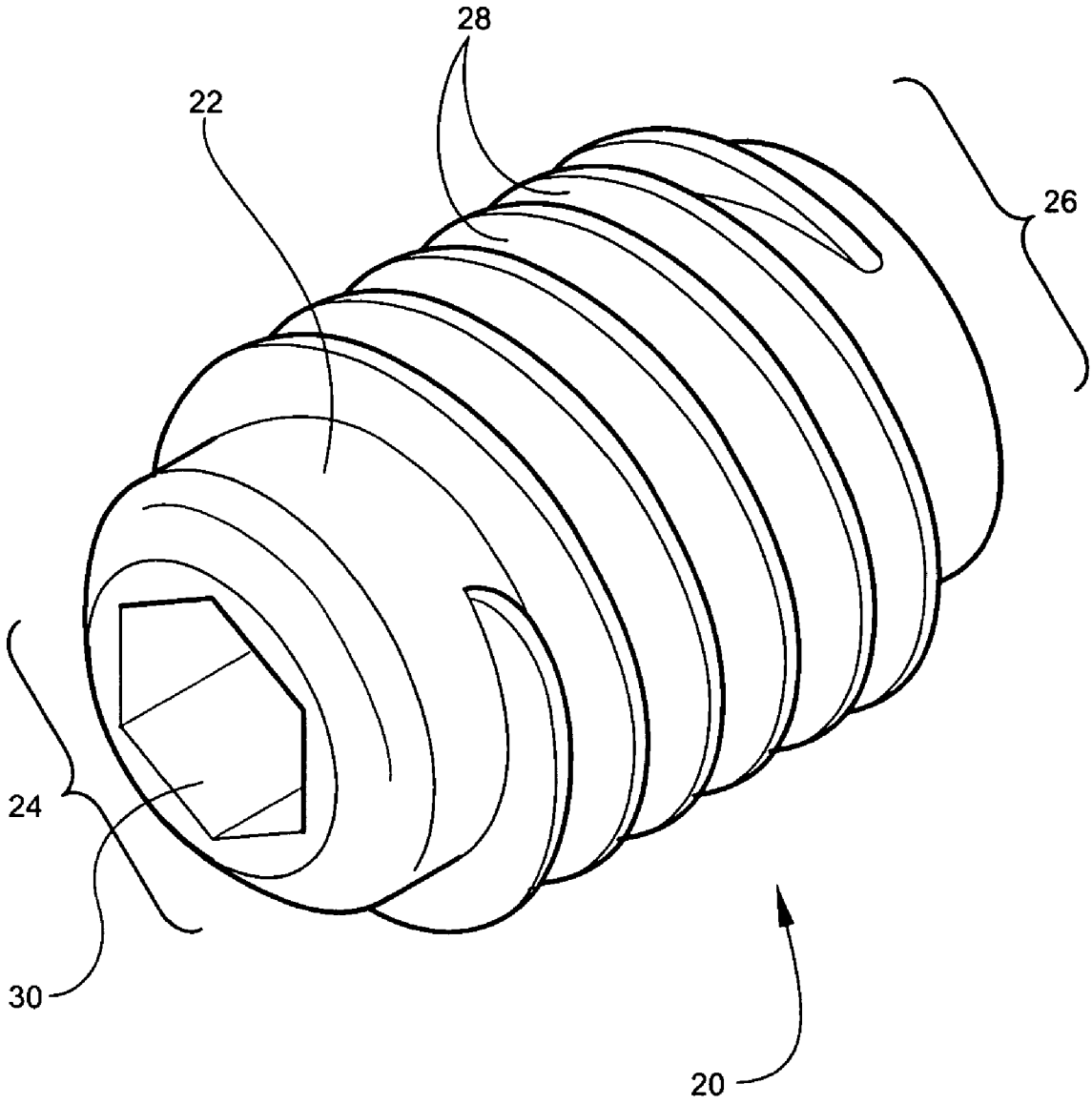
FIG. 5 shows a threaded button for insertion into a threaded aperture in a housing unit in accordance with an embodiment of the present invention.
Figure 6:
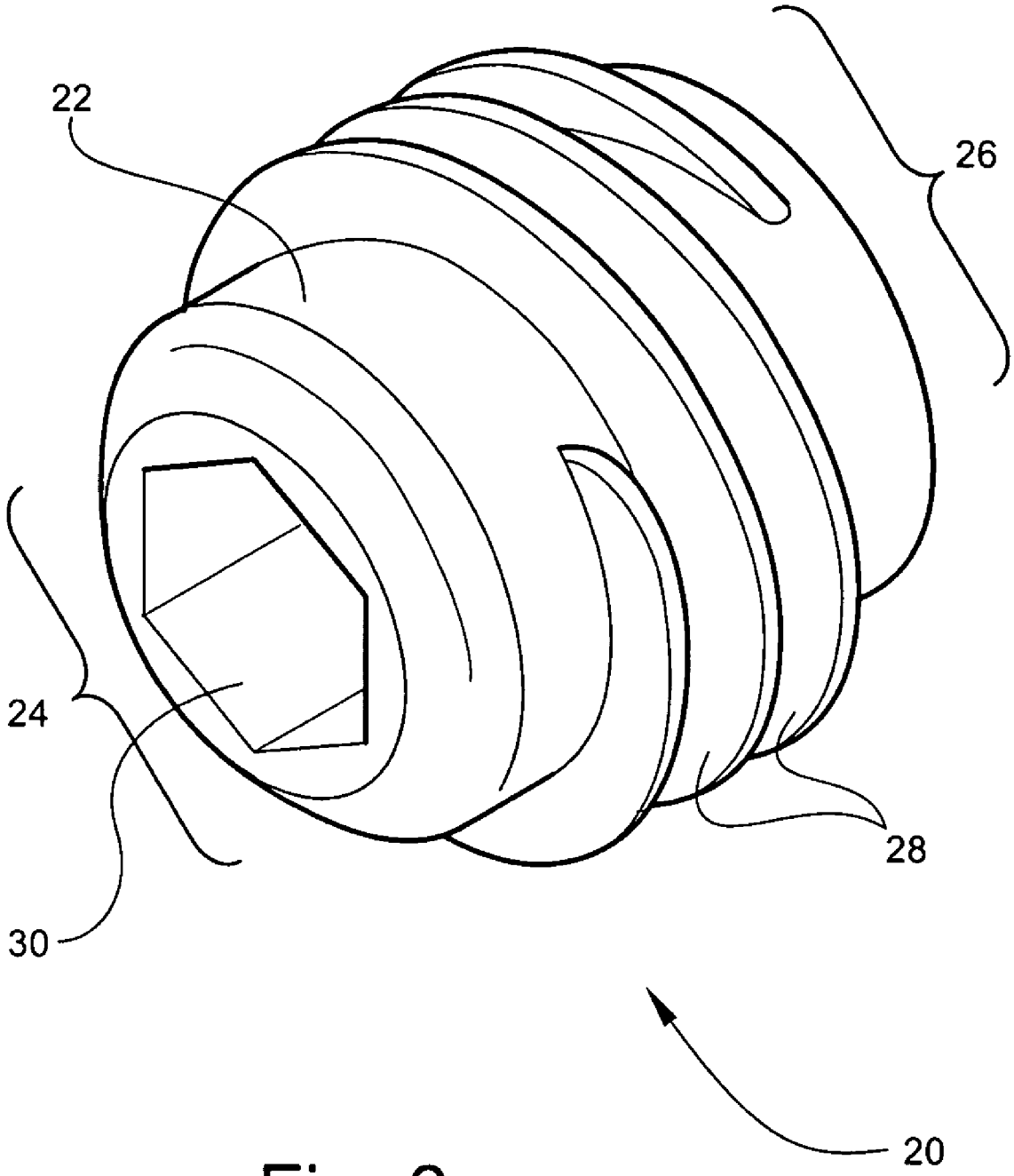
FIG. 6 shows an alternate threaded button for insertion into a housing unit in accordance with an embodiment of the present invention.

FIGS. 5 and 6 show two embodiments of cylindrical threaded buttons (20) of the present invention. It can be seen that in an embodiment, the button comprises two ends (24) (26) and a cylindrical body (22). Also, the body of the button may comprise threads (28) such as those used on a screw. Preferably, the threads (28) on the button (20) match threads in the aperture (10) in the housing (2).

As the button extends from the housing, it presents a relatively smooth, low friction surface. Thus, it may be somewhat difficult to grab the button and turn it. In an embodiment, an aperture for insertion of an Allen wrench (30) may be cut into the button (FIGS. 5 and 6). Other means for turning the insert, such as slots for a standard screw driver, Phillips screw driver, or other types of tools for tightening fastening agents may be adapted to the threaded buttons of the present invention. In yet another embodiment, notches on the longitudinal surface of the button (i.e., the surface perpendicular to the sliding surface) may be used in conjunction with a turning tool to thread the button. Also, where the housing insert takes a form different than a threaded button, other types of tools may be used for emplacement of the insert.

Figure 7:
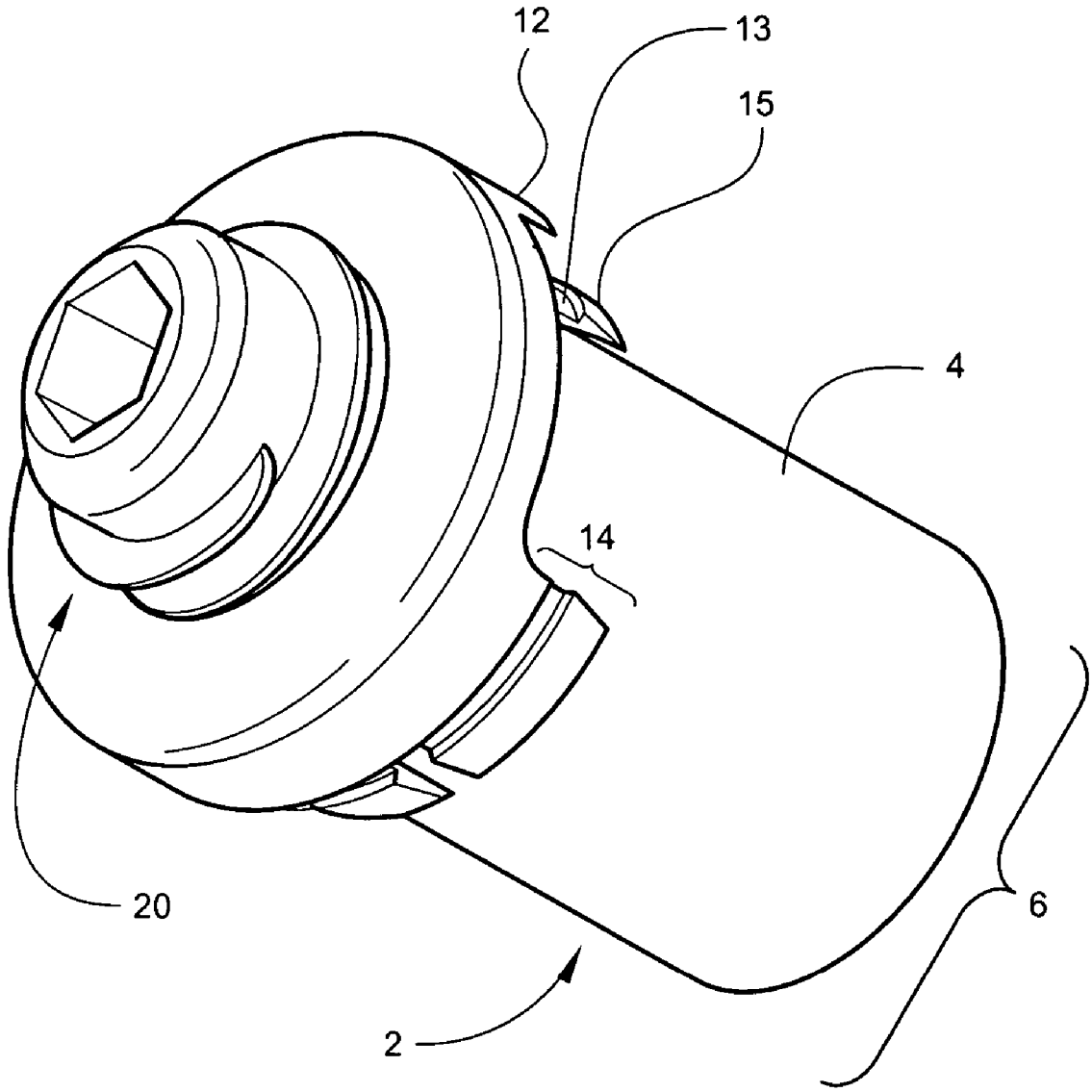
FIG. 7 shows a housing having a button inserted in an aperture in a housing chamber in accordance with an embodiment of the present invention.

FIG. 7 shows a view of a housing that may be used for a vinyl sliding window having a button (20) inserted into the threaded aperture of the housing (2). It can be seen that, in an embodiment, the button extends from the housing to a certain extent. The button may be sized such that even when it is completely tightened down into the housing it will extend beyond the surface of the housing. Alternatively, a button may be inserted into the housing, but not completely tightened. In this way, the length of the button extending beyond the housing may be varied.

Figure 8:
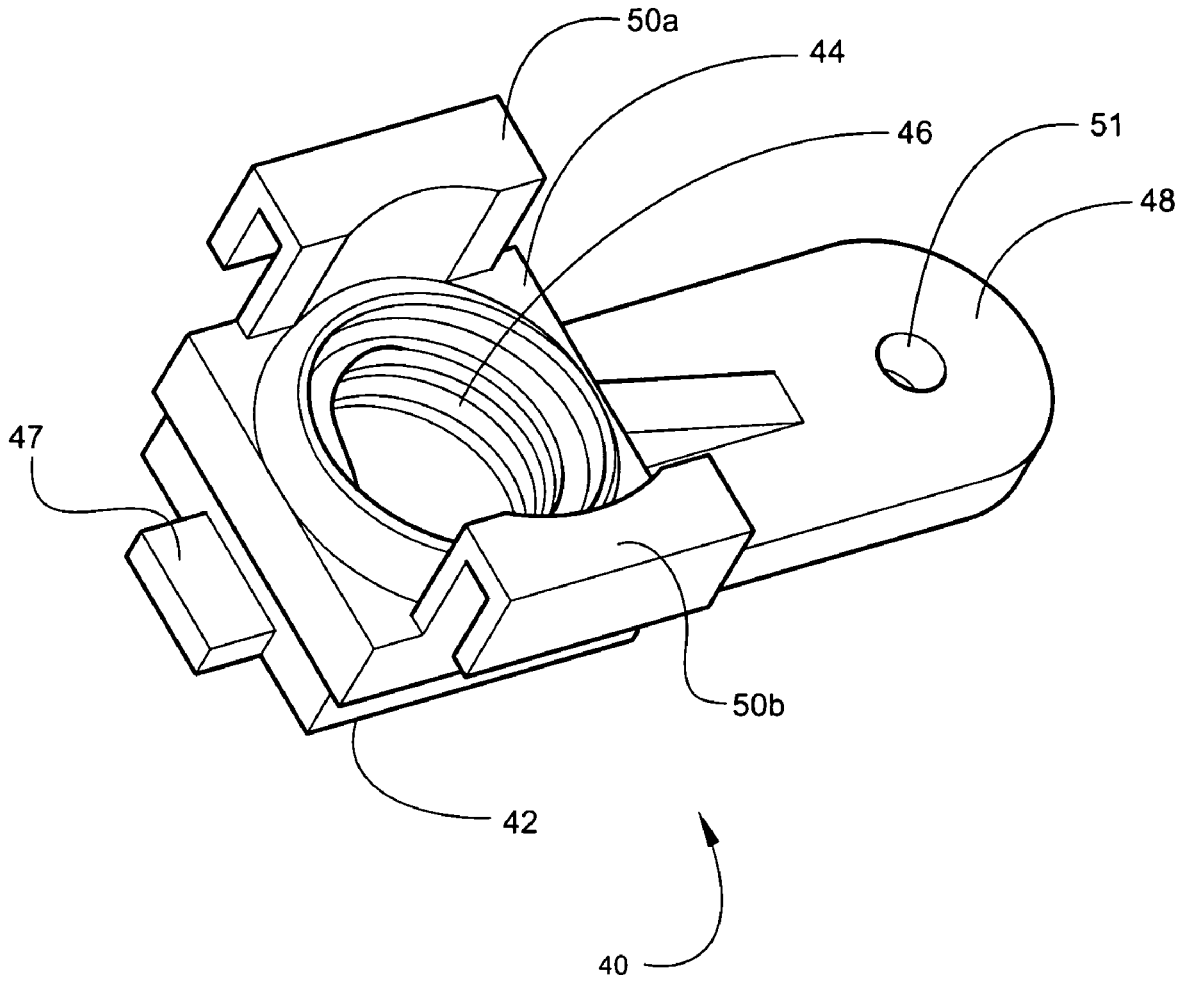
FIG. 8 shows perspective view of an alternate type of housing having two flat planar extension tabs for insertion into a metal window sash in accordance with an embodiment of the present invention.
Figure 9:
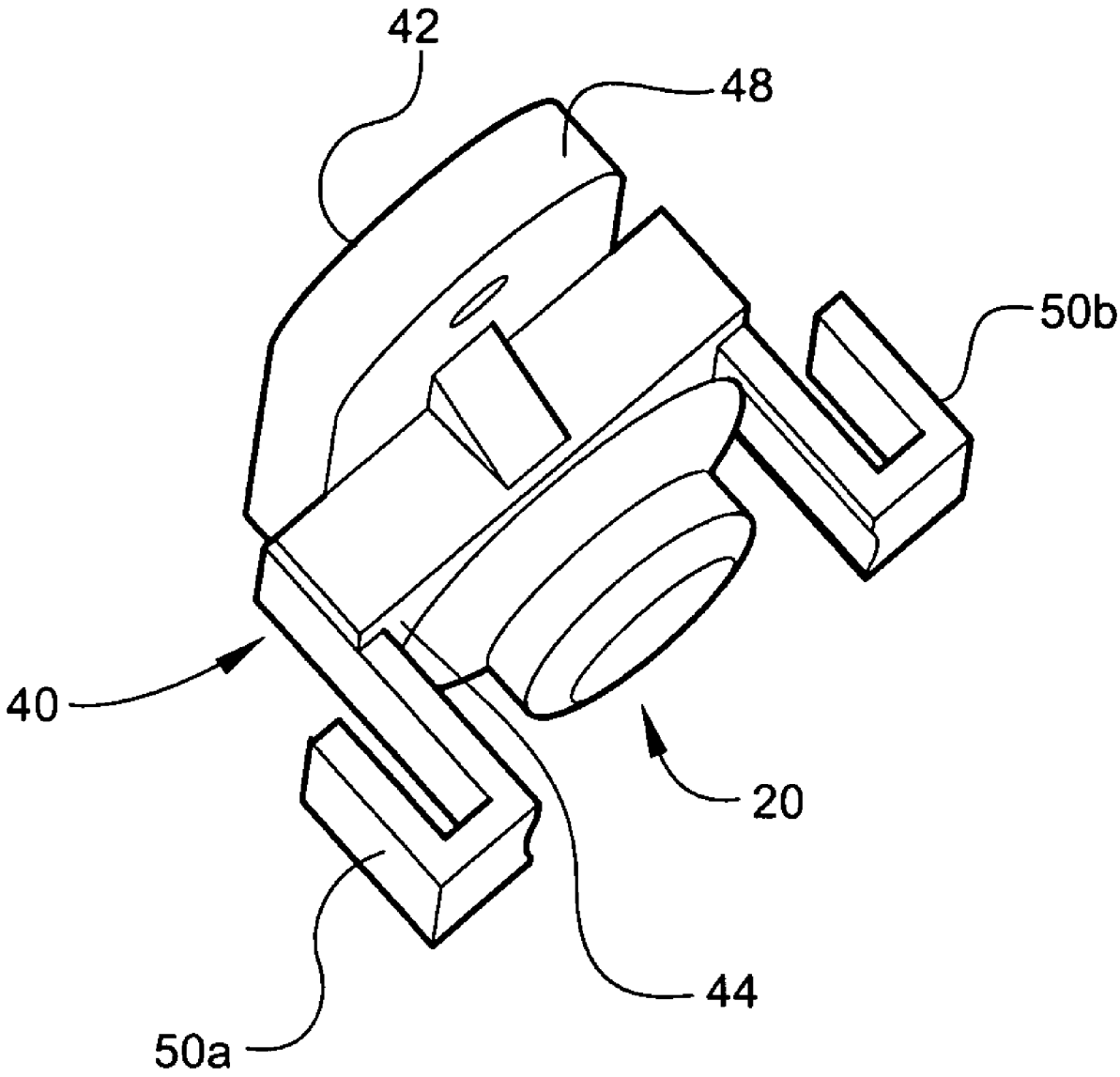
FIG. 9 shows a perspective view of a housing having at least one flat planar extension tab for positioning the housing in a metal window sash and having a button inserted into one end of the housing in accordance with an embodiment of the present invention.

An example of a housing that might be used for a metal (e.g., aluminum) window sash is shown in FIGS. 8 and 9. In this alternate embodiment, the housing (40) again comprises a first side (42) to be inserted into at least a portion of a sliding panel, and a second side (44) that extends from, or is flush with, the surface of the sliding panel. It can be seen that the side that extends from the panel may have an aperture (46) for insertion of a threaded button. In this embodiment, the housing may also comprise a flat planar extension or tab (47) which may be inserted into the frame of the rail used for a metal window as a means to insert the housing. Also, the housing may have a second tab (48) for fastening the housing to the sash. In an embodiment, the second tab (48) may comprise an aperture (51) for insertion of a screw or other fastening agent.

Also shown are guides (50*a* and 50*b*) for positioning the housing in the frame of the sliding panel. The guides may be U-shaped to engage elements of the sash assembly. In this way, the U-shaped guides position the housing in the frame of the sliding panel.

Thus, in an embodiment, tab (47) is positioned in a hole that is created in the aluminum sash and is wedged in the hole. The housing may be fixed in place via the second tab (48) on the other side of the housing that is attached to the sash via a screw or other fastening agent as the sash is assembled. Also, in an embodiment, guides (50*a* and 50*b*) that fit over a wall within the bottom rail may be used to help hold the sash in position and to guide the sash back and forth in relation to the track.

FIG. 9 shows a view of a housing for a metal window (40) with a threaded button (20) inserted into the housing. It can be seen that, in an embodiment, the button extends from the housing to a certain extent, but does not extend beyond the U-shaped positioning guide (50). In the case of a metal window, a track may extend up between these positioning guides to rest against the button. The positioning guides thus act to align the track of the window unit with the button and the sliding rail of the window. As with the assembly for a vinyl window, the button is sized such that even when it is completely tightened down into the housing it will extend beyond the surface of the housing. Alternatively, a button may be inserted into the housing but not completely tightened. In this way, the length of the button extending beyond the housing may be varied.

The inserts for the housing are not limited to threaded screws. Thus, the present invention comprises alternate button shapes. For example, the button may comprise a threaded piece that is non-symmetrical in shape such that the correct end of the button to be inserted in the housing may be identified. Or, the buttons may comprise a spherical shape that can be inserted into a housing unit having a substantially semi-spherical aperture. Or, the inserts may comprise substantially cylindrical inserts having annular ridges spaced along the length of the body of the insert that match ridges cut in the aperture. In such an embodiment, how far the button extends will depend on if the button is inserted to a first, second, third, or further stop point. Or, the insert may comprise a snap button. In yet another embodiment, the insert may comprise a threaded cylinder having an exterior portion specifically shaped to fit in the track in which the sliding panel sits. For example, in an embodiment, the head may be L-shaped or shaped as an inverted T.

The method used to install the housing may depend in part on the type of sliding panel used. For example, for a vinyl window, a hole having a circumference similar to the outer circumference of the housing can be drilled into rails in the bottom window sash and the housing inserted into the hole. In an embodiment, the housing is pushed into the hole. Alternatively, the outer circumference of the housing may be threaded, and the housing threaded into the sash. Alternatively, the housing may be formed as a modular component of a window sash, such that it may be added during the manufacture of the window sash. For example, the window sash may be constructed as an injection mold. In this case, the housing can be part of the sash component and the button threaded into the sash. Also, the housing may be glued or welded to the doorframe or window sash.

In an embodiment, the circumference of the aperture drilled into the sliding panel is substantially the same (i.e., within the accuracy range standard in the art) as the circumference of the housing. Alternatively, to facilitate insertion of the housing, the circumference of the aperture drilled into the sliding panel is larger than the circumference of the housing. In this embodiment, positioning guides such as the expandable springs (14) shown in FIGS. 1-4 may be used to secure the housing in the sliding panel. Or, the circumference of the aperture drilled into the sliding panel may be slightly smaller than the circumference of the housing, such that the housing is squeezed into the hole and expands the hole outward.

Figure 10:
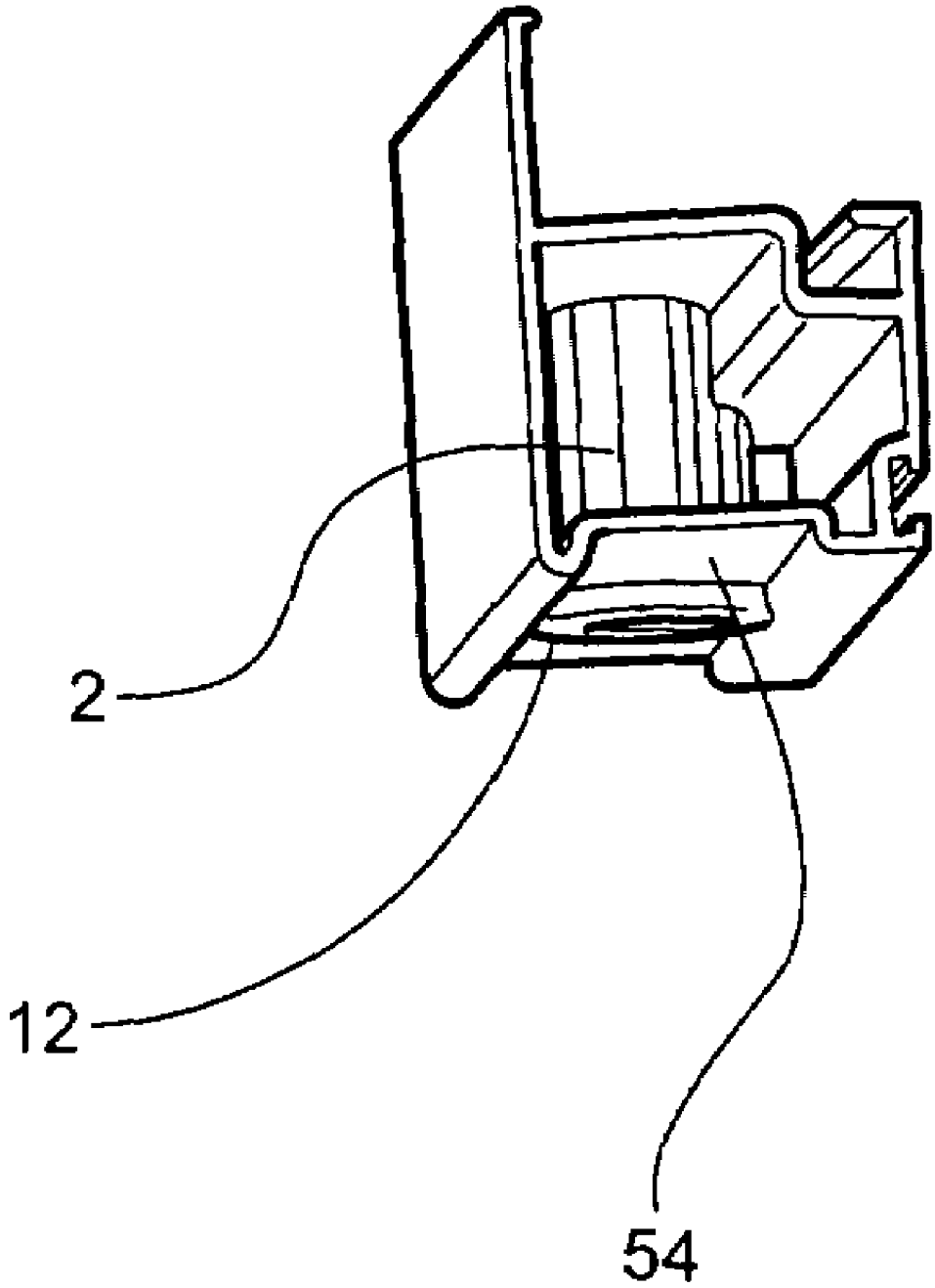
FIG. 10 shows a schematic of a housing unit inserted into a vinyl window sash in accordance with an embodiment of the present invention.

Alternatively and/or additionally, positioning guides on the end of the housing may be used to limit the amount that the housing can be inserted into the aperture. FIG. 10 shows an embodiment of a housing of the present invention being installed in a vinyl window sash. Thus, as shown in FIG. 10, the housing (2) may be positioned in the rail of a window sash (54) by pushing the housing into a hole drilled into the rail until the lips that extend from the second end of the housing (12) abut against the outer surface of the rail. In an embodiment, the lips on the housing (12) are shaped to fit within the geometry of the sash rail. For example, in an embodiment, a circular lip may be trimmed to have two flat edges (FIG. 3), such that when the housing is inserted into a sash rail, the long axis of the lip is parallel to the length of the rail into which the housing is inserted, and the shorter axis of the lip spans the width of the rail. In this way, the lip supports the housing unit against the rail, while providing maximum diameter for the threaded button. Also, in an embodiment, the lip on the end of the housing works in conjunction with the spring-like expandable elements on the housing (14) (not shown in FIG. 10) which hold the housing in place against the inner surface of the cavity of the rail.

Figure 11:
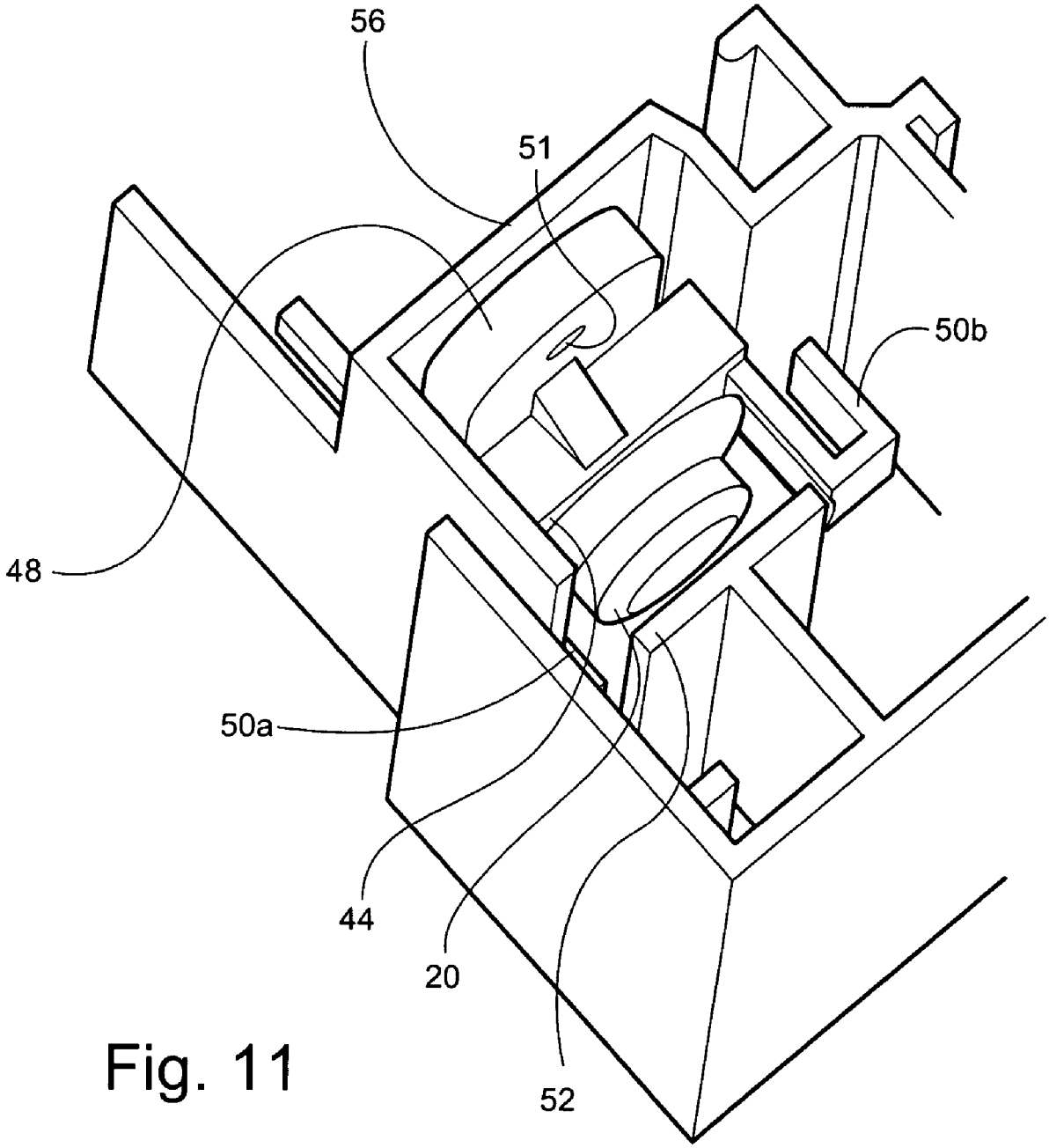
FIG. 11 shows a schematic of a housing unit inserted into an aluminum window sash in accordance with an embodiment of the present invention.

FIG. 11 shows a housing being installed in an aluminum window sash. Shown is the portion of the sash (56) and track (52) corresponding to the lower right hand corner of the window. As shown in FIG. 11, the window sash (56) slides back along the track (52) away from the viewer. For an aluminum window, a part of the sash rail (56) may be sheared and the housing inserted by sliding a positioning tab (47) on the housing into that portion of the rail. The tab (47) is not shown in FIG. 11, but extends away from the viewer on the other side of the housing from the second tab (48). At that point, the sash is assembled, and the sash assembly screw is inserted through an attachment hole (51) in the second fastening tab (48) and into the sash rail, thereby fixing the housing in place.

FIG. 11 also shows the use of the positioning guides (50*a* and 50*b*) to position the housing in the sash. Thus, in an embodiment, one positioning guide (50*a*) wraps around the edge of the sash that abuts the track, to hold the housing in place in the sash. Only one guide is needed to position the housing in the sash. Whether the guide used is clockwise or counterclockwise in relation to the fastening tab (48) will depend on which end of the sash the housing is installed. In the orientation shown in FIG. 11 (for a housing on the lower right hand edge of the window) the counterclockwise, or lower-left, positioning guide (50*a*) is used. For a housing installed on the low left corner of the sash, the fastening tab (48) would be positioned to face the stile, and the other positioning guide (50*b*) (clockwise to the fastening tab) would be used.

Figure 12A:
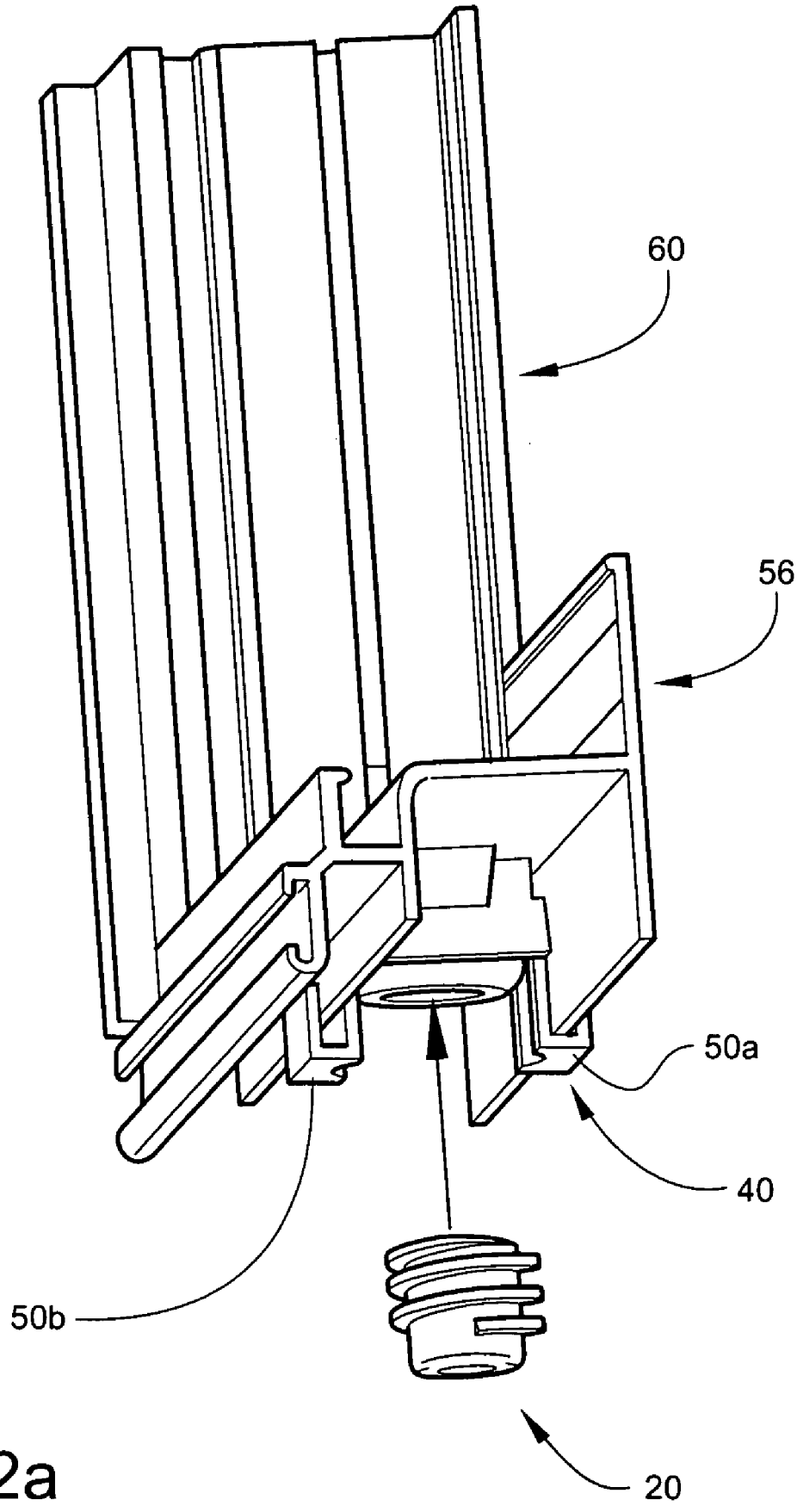
FIG. 12 depicts the process of inserting an adjustable button of the present invention into a window sash in accordance with an embodiment of the present invention, where panel (A) shows the window sash without the button and panel (B) shows the sash with the button inserted.
Figure 12B:
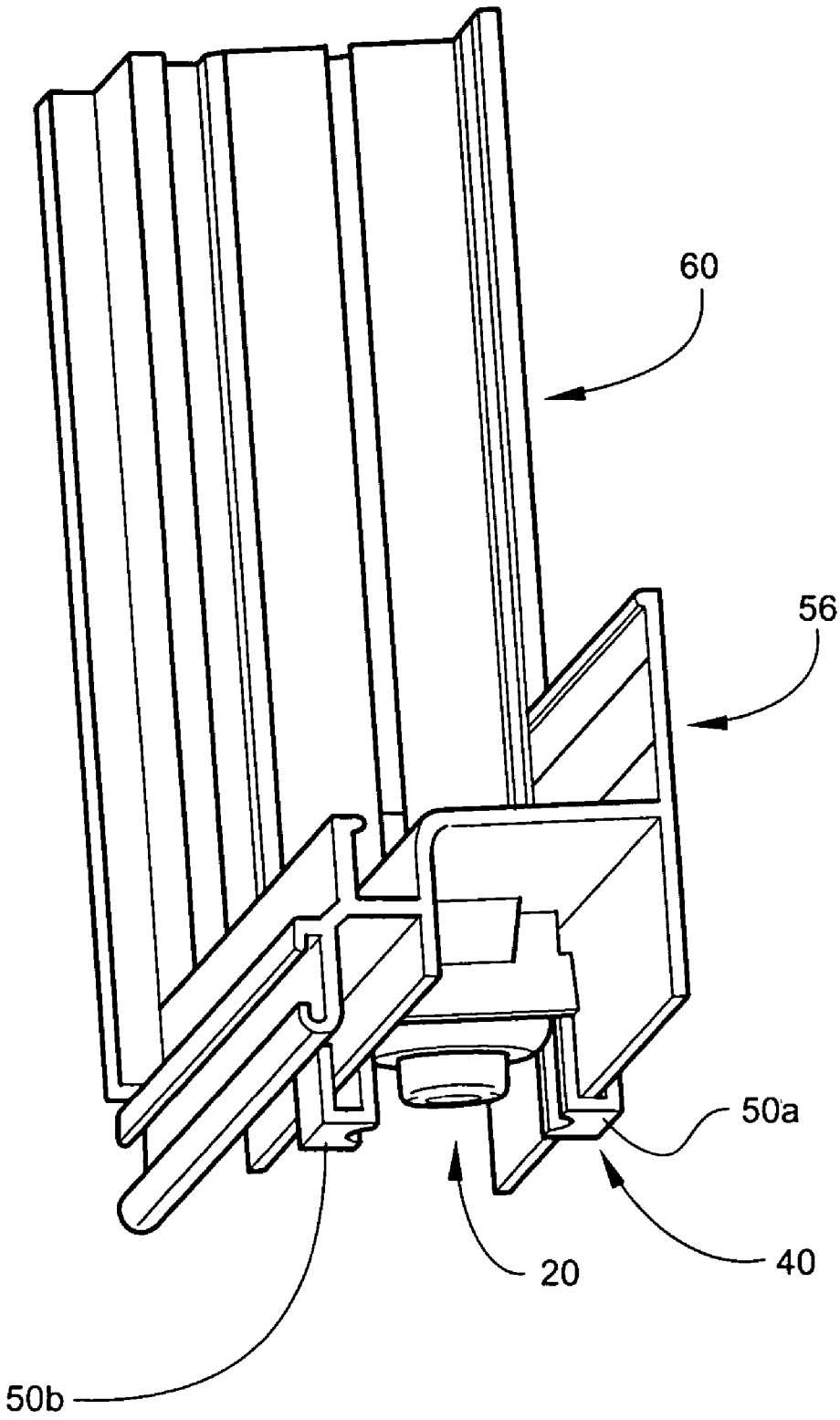

In an embodiment, the insert may be placed in the housing prior to insertion of the housing in the sliding panel. Alternatively, the insert may be placed in the housing after the housing has been inserted into the window sash. Thus, the housing may be inserted without the button included, and a threaded button selected to maximize positioning of the window in its track. Alternatively, the housing and button may be installed as a unit, and the amount that the button extends from the sliding panel kept fixed or adjusted as necessary after the window is installed in the building. For example, for either a vinyl or an aluminum window, a plurality of housing units having threaded button inserts may be installed into holes drilled into the window and the sash then inserted on the window. Once the window is brought to the building where it is to be placed, the buttons may be further aligned as required. FIG. 12 shows a housing (40) inserted in a window sash where the sash comprises a horizontal rail (56) and a vertical stile (60) and the subsequent insertion of a threaded adjustable glide button (20) into the housing.

By inserting two or more buttons into the frame of a sliding panel, a surface having a relatively low frictional coefficient will extend from the sliding panel. By varying the sizes of the buttons inserted into the housing, or the extent that the buttons are threaded into the housing, the distance that the buttons extend from the frame of a sliding panel is varied. Buttons of different size may provide a different range of adjustability. For example, in an embodiment, the buttons may extend up to about ½ inch from the housing, and/or the surface of the sliding panel. In another embodiment, the buttons may extend up to about ¼ inch from the housing, and/or the surface of the sliding panel. In yet another embodiment, buttons may extend about up to ⅛ inch from the housing, and/or the surface of the sliding panel. Other embodiments, comprising different extension ranges are included in the present invention. Thus, the vertical positioning of the sliding panel may be varied by changing the size of the button used, or the extent that the button is threaded into the housing.

Thus, the buttons of the present invention provide a means to adjust the window height. Many sliding windows employ a self-latching lock system. The self-latching lock uses a spring mechanism to lock the window once it has been completely shut. To function properly, self-latching locks require both parts of the lock (i.e., the part on the window and the part on the window sill) to be precisely aligned. Often, during construction, or as the house settles, the window sill may move relative to the window, such that the two parts of the lock come out of alignment. To realign the lock then requires that one part of the lock be removed and repositioned with respect to the other part of the lock.

Figure 13:
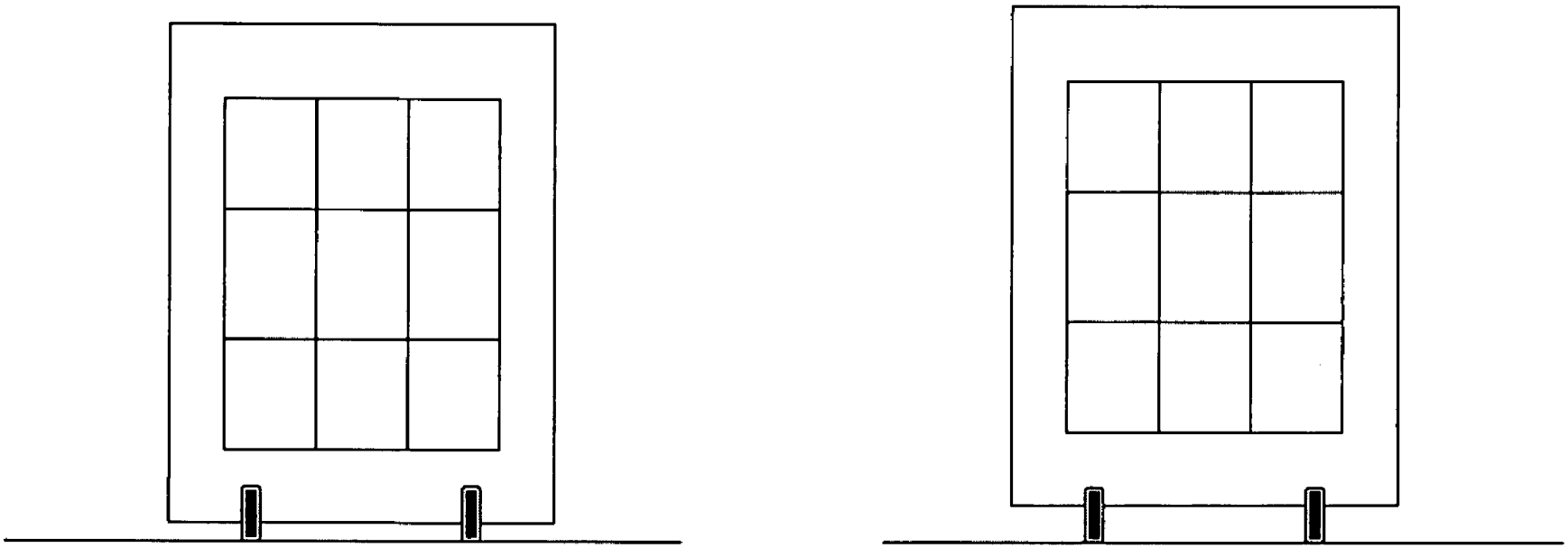
FIG. 13 shows the use of the threaded buttons to raise or lower a window relative to the window sill in accordance with an embodiment of the present invention.

The sliding assembly of the present invention provides a means to easily adjust the window height. Thus, by decreasing or increasing the amount that the threaded inserts extend from the window sash, the window may be lowered or raised, respectively, compared to the sill (FIG. 13).

In an embodiment, the present invention comprises a method for making a sliding panel. In an embodiment, the method comprises fitting a sliding panel with a housing into which an adjustable button can be inserted. The adjustable button provides a surface on which the panel can slide. In addition, the adjustable button allows for the height of a sliding window or door to be adjusted relative to its surrounding frame. A diagrammatic representation showing an embodiment of the method is presented as FIG. 14.

In an embodiment, the first step of the method may comprise preparing the housing and inserts. As described herein, for plastic housing and inserts, injection molding may be used. As described herein, the housing may comprise a variety of designs depending upon the sliding panel for which it is used. Generally, the housing comprises a chamber having a first end and a second end, such that the first end is shaped for insertion into a sliding panel and the second end comprises an aperture for the insert. Also, in an embodiment, the housing may comprise a guide for positioning the housing in the sliding panel.

Figure 14:
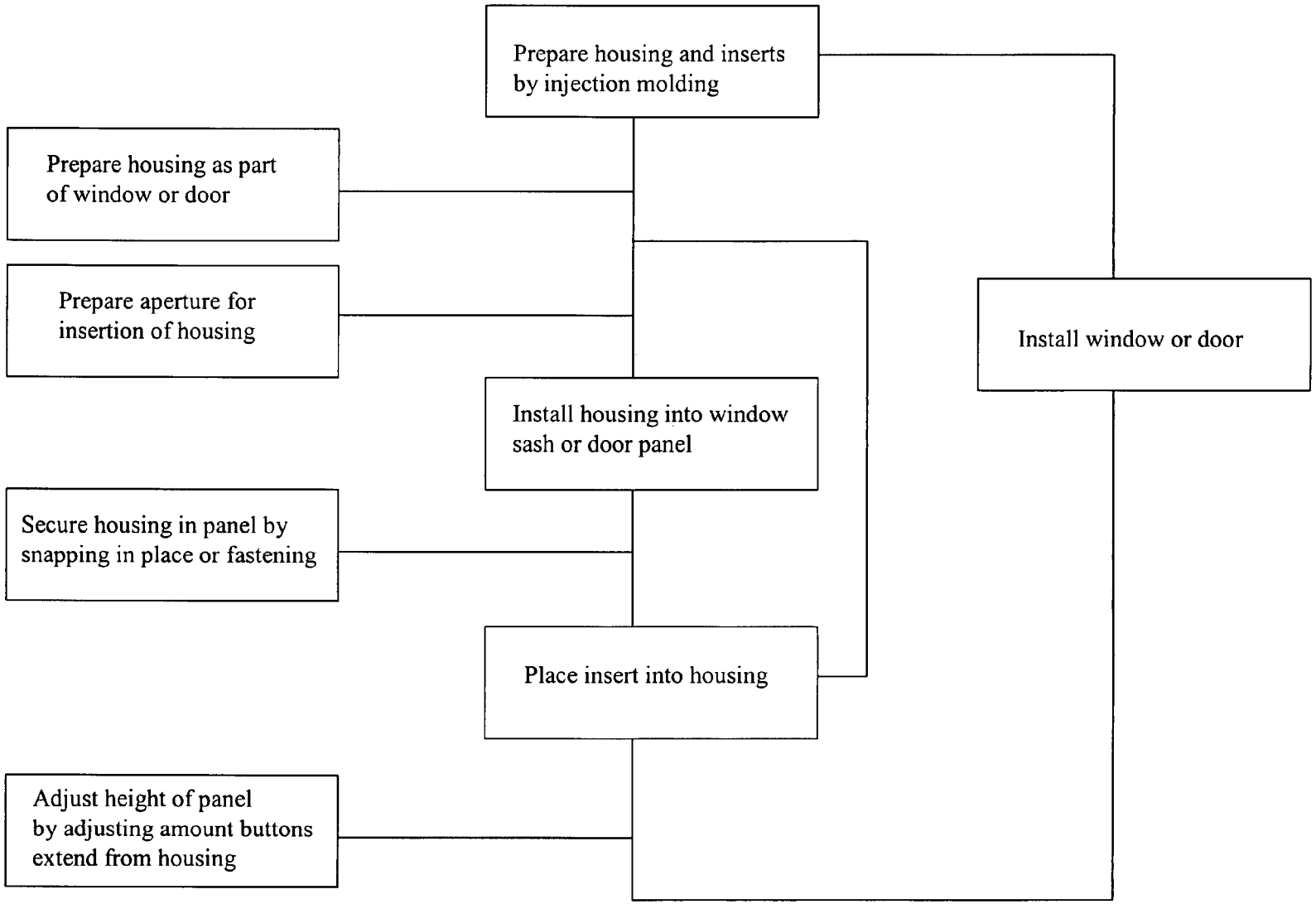
FIG. 14 shows a schematic of methods of applying the adjustable buttons to a window sash in accordance with an embodiment of the present invention.

Next, the housing may be installed in the sliding panel. The housing unit is designed to fit in the portion of the panel that abuts, and slides along, an external surface. As described herein, placing the housing in the sliding panel may require different methods depending upon the type of panel. For example, in an embodiment the housing is designed to fit in the bottom rail of a window sash or door panel. Thus, as described herein, in an embodiment the housing is inserted into a hole that has been drilled into the sliding panel (e.g., vinyl window or door). Or, the housing may be directly fastened to a metal rail (aluminum window or door). Or, the housing may be press-fit or threaded into a wooden panel. Or, the door may be made such that the housing is included as a modular component (FIG. 14).

The number of adjustable glide button assemblies used will depend on the nature of the sliding panel. For example, for a standard 48 inch by 48 inch window, two housing assemblies may be used. For larger windows, or sliding doors, more assemblies may be required.

Once the housing has been installed, inserting the button insert is straightforward. Thus, the insert may simply be screwed into the housing. Or, for alternate embodiments, the insert may be a cylinder having annular ridges; in this embodiment, the insert may be pressed into an aperture in the housing having matching ridges until the correct position is reached. Also, as described herein, the insert may be positioned in the housing prior to installation of the housing in the sliding panel (FIG. 14).

Next, the height of the sliding panel is adjusted to be compatible with its frame by adjusting the extent that the insert extends from the aperture in the housing aperture. As described herein, in an embodiment, adjusting the height may comprise turning a threaded insert so that the amount that the insert extends from the housing is altered. Also as described herein, other methods of adjusting the height of the housing may be used. Similar to placing the insert in the housing, adjusting the height of the sliding panel may be done using everyday tools. Also, in an embodiment, the position of the insert may be adjusted at any time during the use of the sliding panel.

As indicated in FIG. 14, it will be understood that the adjustable glide buttons of the present invention may be installed in the sliding panel during the manufacture of the panel. Alternatively, the adjustable glide buttons of the present invention may be installed in the sliding panel after the panel has been installed at the site. Thus, the adjustable glide buttons may be added to pre-existing doors and window units as a means to improve the functioning of such units, or to allow for the installation of self-latching locks.

EXAMPLES

The present invention may be better understood by reference to the following non-limiting examples.

Example 1

Prototype Sliding Units for Vinyl Windows

Two types of housing units were made for vinyl windows. A first housing model has a cylindrical body about 13/16 inches long and an outer diameter of about 5/8 inches. The housing has a threaded aperture about 3/8 inches in diameter and about 7/16 inch deep in the end corresponding to the outer face of the housing, and a second hole, also about 3/8 inches in diameter in the end corresponding to the inner face of the housing.

The housings were made by injection molding; the threads were created during the molding process. It will be understood by those in the art, however, that the housing may also be cast from metal, or made using materials and methods commonly used to make solid parts.

A flat planar overhang (or lip) was formed on the end of the housing having the threaded hole. The overhang extends perpendicular to the axis of the cylindrical body of the housing. For this first housing, the lip extends beyond the circumference of the housing body by about 1/8 inch. In some cases the lip is circular in shape. In an alternate model, the circular lip was trimmed to have two flat edges, such that when the housing is inserted into a sash rail, the long axis of the lip is parallel to the length of the rail into which the housing is inserted, and the shorter axis of the lip spans the width of the rail. In this way, the lip supports the housing unit against the rail, while providing maximum diameter for the threaded button (FIG. 3).

The housing was formed to include flexible spring-like tabs that are positioned around the upper circumference of the body of the housing. As shown in FIGS. 1-4, the tabs extend down from the body of the lip via thin connectors. The tabs include ridges that are angled inwardly; the ridges allow a housing to be inserted into a hole drilled into a rail. The tabs were produced as part of the molding process. The tabs are approximately 1/4 inch by 1/8 inch. As shown in FIGS. 1-4, the tabs include flexible connecting pieces (13) that are about 1/32 inch in thickness. The connecters terminate in an arrow-shaped tip (15) which is about 1/16 inch thick where the ridge of the arrow meets the connecting piece.

A second housing model similar to the first housing but having at least one flat surface along the body of the housing was made. This second housing model has a cylindrical body about 15/16 inches long and an outer diameter of about 5/8 inches. Like the first housing described above, the second housing has a threaded aperture about 3/8 inches in diameter and about 7/16 inches deep in the end corresponding to the outer face of the housing, and a second hole in the end corresponding to the inner face of the housing. In contrast to the first housing, however, the body of the second housing is not completely cylindrical, but includes one flat (i.e., planar) face. This planar face does not extend along the entire body length of the housing, but is about 5/16 inches long by about 1/2 inch wide and terminates at the inner end of the housing. The flat face of the second housing is designed to rest against an internal rib within the sash component of the window sash and thus, provides a means to clear the interior wall of the window sash. Also, the hole in the inner end of the housing is not completely circular, but includes one planar face matching the planar face on the outside of the housing.

Both the second housing and the first housing described above were made from nylon or fiber-filled nylon. It will be understood by those in the art that similar materials may be used. Also, in some cases the housing may be made from metal, or some other non-plastic material.

The threaded buttons which comprise inserts for the housing were cut from a cylindrical rod. The buttons were threaded during the injection molding process. Once the buttons were cut to the required size, the ends were rounded to provide a smooth surface at the edges of the cylinder. The face of the button that extends from the housing may be rounded or flat. Generally, the face of the button that extends into the housing is flat. Also, an octagonal aperture was drilled in one end of the button for insertion of an Allen wrench.

Buttons may come in various lengths and widths depending on the size of the housing used. For example, buttons made of nylon and molded to the shape of a cylinder about 5/8 inch in length and 3/8 inch in diameter have been used. In some cases cylinders about 3/8 inch in length and having three threads are used. Alternatively, cylinders about 5/8 inch in length and having 6 threads are used. For both buttons, the threads comprise one circumference about every 1/16 inch to match the thread density used in the housing.

A third housing model was made for use with aluminum windows. The housing used for aluminum windows were also made by injection molding using fiber-filled nylon. As shown in FIGS. 8 and 9, the housing used for aluminum windows comprises a square or rectangular body (e.g., 5/8 inch by 5/8 inch by 3/16 inch deep) having a flat face to be placed against the sash rail and a hole in the outwardly facing side of the housing. As described for the housings used in vinyl windows, the hole is about 3/8 diameter and 7/16 inch deep. Also as shown in FIGS. 8 and 9, the housing has an extended surface on the back side of the housing which essentially comprises a small tab that extends on one side of the housing, and a larger tab that extends from the other side of the housing. The small tab is about 1/8 inch by 1/4 inch and is used to position the housing in a slot cut into the aluminum sash rail. The larger tab (fastening tab) is about 15/16 inch long and 1/2 inch wide and rounded at the end. A hole was bored in the fastening tab for insertion of a screw or other fastener.

Also as shown in FIGS. 8 and 9, two U-shaped pieces extend from the outer face of the housing. The tabs are 1/4 inch by 1/2 inch on the inner face, have a connecter that extends outwardly by about 1/8 inch (i.e., 1/8 inch long by 1/2 inch wide), and then descend back towards the housing to form the outside of the tabs (also 1/4 inch by 1/2 inch).

Example 2

Insertion of Sliding Units in Windows

The first housings shown in FIGS. 1 and 2, and the second housings shown in FIGS. 3 and 4, can both be used with vinyl windows. The housings are inserted into holes created in the sash component approximately 2 inches from each end of the sash assembly. Two housings are utilized per window. The housing units are then pushed into the hole such that the concentric flaps attached to the lip are inserted into the hole. The lip remains in the hole and engages the internal surface of the rail. Thus, the housing units are essentially 'snapped' into place. Then, the inserts are threaded into the housing units using an Allen wrench for tightening.

To test the glide button design, sample window units were built. In order to provide basic information a 48-inch wide by 36-inch tall vinyl window unit size was selected. To install the button and housing assembly the installation hole was drilled in the bottom rail. Two holes were drilled, one at each end of the bottom rail of the sash assembly. Each hole was cleared of any residue that may have remained after the drilling process. Each hole was drilled at the specified location based on the current specifications for the product. After preparing the holes the adjustable glide button housings were installed by snapping them into the holes. Once the housings were in place, the glide buttons were threaded into the housings and tightened down. The sash assembly was then installed into the window unit's frame assembly by inserting the top of the sash into the frame, lifting the sash up and slipping the bottom of the sash assembly over the bottom of the frame, thus setting the assembly onto the window track. After installing the sash, the sash assembly was operated by sliding it back and forth across the window sill track.

The window unit was installed in an opening and submitted to extensive cycling along the track. Multiple cycling did not show any significant wear to the glide buttons. Pivoting (e.g., spinning of the button within the threaded hole in the glide button housing) was found to be minimized by increasing the diameter of the button by approximately 0.005 inches to increase the friction between the button and the housing.

As described above, the housing used for an aluminum window is a different design than the housing used for a vinyl window. The aluminum housing is attached by inserting the tab into a hole created in the aluminum sash component. The housing is then fixed in position using a screw or other type of fastener. Generally two housings will be utilized per window. The housings will be placed approximately 2 inches from the each end of the aluminum sash assembly. Then, the inserts are threaded into the housing units using an Allen wrench for tightening.

As described above, once in position, the glide button assembly allows unimpeded movement of the window sash across the length of the track, which is positioned in the sill of the window frame.

Thus, the present invention provides adjustable mechanisms for facilitating accurate positioning and movement of a sliding panel. The adjustable buttons of the present invention provide a surface having reduced friction that extends from the bottom edge of a window or door and that can slide along a track supporting the window or door. In addition to providing a mechanism to facilitate horizontal sliding of a window or door, the adjustable mechanism may be used to set the height of the sliding window or door as it sits in the track.

Embodiments of the present invention offer a wide variety of advantages and features. For example, one advantage and feature of the present invention is to provide a system that avoids the use of roller wheels. Such roller wheels can be costly and time-consuming to install. Also, rollers can become contaminated with dirt and grit thereby seizing up so as to no longer roll.

Another advantage of the gliding buttons of the present invention is the adjustable nature of the system. The roller wheels previously used for most sliding windows and doors only have two, or at most three, different positions. Also, once installed, the pins used for sliding windows are not adjustable. In contrast, the buttons of the present invention allow the sliding panel to be vertically repositioned in its frame. For example, self-latching locks often used with sliding windows require precise alignment. Thus, even a small shifting or setting of the building can require realignment of a window in the window sill. Using the gliding buttons of the present invention allows the window to be realigned simply by adjusting the distance that the button extends from the window.

It will be understood that each of the elements described above, or two or more together, may also find utility in applications different from the types described. While the invention has been illustrated and described as an adjustable mechanism for sliding panels, it is not intended to be limited to the details shown, since various modifications and substitutions can be made without departing in any way from the spirit of the present invention. As such, further modifications and equivalents of the invention disclosed herein may occur to persons skilled in the art using no more than routine experimentation, and all such modifications and equivalents are believed to be within the spirit and scope of the invention as described herein.

That which is claimed:

1. An article of manufacture comprising a panel having at least one adjustable assembly supporting the panel at least partially within a track supporting the panel in a frame, wherein the adjustable assembly comprises:

(a) a housing comprising a chamber having a first end and a second end, such that the first end is shaped for insertion into the panel and the second end comprises an aperture, and further comprising at least one guide for positioning the housing in the panel;

(b) an insert that fits into the aperture on the second end of the housing extending beyond the second end of the housing and the panel, wherein the insert comprises a surface that abuts the track and supports the panel in the track; and (c) means for adjusting a position of the panel with respect to the track.

2. The article of manufacture of claim 1, wherein the panel comprises a window.

3. The article of manufacture of claim 1, wherein the first end of the housing is positioned at a preset distance from the second end of the housing such that when the housing is inserted into the panel, the first end of the housing abuts at least a portion of the panel.

4. The article of manufacture of claim 1, wherein the positioning guide extends from an external surface of the housing to abut a portion of the panel.

5. The article of manufacture of claim 1, wherein the positioning guide comprises a flat planar surface that extends from the housing in a direction that is perpendicular to the length of the housing body.

6. The article of manufacture of claim 1, wherein the positioning guide exerts an outward force from the housing to impinge on at least a portion of the panel.

7. The article of manufacture of claim 1, where the insert is cylindrical in shape.

8. The article of manufacture of claim 1, wherein the adjusting means comprises a threaded surface in the housing.

9. The article of manufacture of claim 8, wherein the adjusting means further comprises a threaded surface on the insert compatible with the threaded surface in the housing.

10. The article of manufacture of claim 1, further comprising means for re-adjusting the position of the panel with respect to the track after the panel is installed in the track.

* * * * *